US007342564B2

(12) United States Patent
Ham et al.

(10) Patent No.: US 7,342,564 B2
(45) Date of Patent: Mar. 11, 2008

(54) METHOD AND APPARATUS FOR DRIVING LIQUID CRYSTAL DISPLAY

(75) Inventors: Yong Sung Ham, Ahnyang-Shi (KR); Hong Bae Park, Kunpo-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 268 days.

(21) Appl. No.: 10/606,752

(22) Filed: Jun. 27, 2003

(65) Prior Publication Data

US 2004/0119730 A1 Jun. 24, 2004

(30) Foreign Application Priority Data

Aug. 8, 2002 (KR) ..... 10-2002-0046858
Nov. 27, 2002 (KR) ..... 10-2002-0074365

(51) Int. Cl.
*G09G 3/36* (2006.01)

(52) U.S. Cl. ..... 345/98

(58) Field of Classification Search ..... 345/87, 345/98–100, 204
See application file for complete search history.

(56) References Cited

U.S. PATENT DOCUMENTS 6,853,384 B2 * 2/2005 Miyata et al. ..... 345/601
2001/0038372 A1 * 11/2001 Lee ..... 345/89
2002/0030652 A1 * 3/2002 Shibata et al. ..... 345/87
2002/0196221 A1 * 12/2002 Morita ..... 345/87

FOREIGN PATENT DOCUMENTS

EP 517383 A2 * 12/1992

* cited by examiner

*Primary Examiner*—Amr A. Awad
*Assistant Examiner*—Stephen Sherman
(74) *Attorney, Agent, or Firm*—McKenna Long & Aldridge LLP

(57) ABSTRACT

A method for driving a liquid crystal display, includes receiving source data, reducing the number of bits of the source data, thereby generating a reduced-bit source data, comparing the reduced-bit source data of a previous frame with the reduced-bit source data of a current frame to select a preset modulated data in accordance with the result of the comparison, and modulating the source data by using the selected modulated data.

16 Claims, 18 Drawing Sheets

METHOD AND APPARATUS FOR DRIVING LIQUID CRYSTAL DISPLAY

The present invention claims the benefit of the Korean Patent Applications No. P02-046858 and P02-074365 filed in Korea on Aug. 8, 2002, and on Nov. 27, 2002, respectively, both of which are hereby incorporated by reference.

BACKGROUND OF THE INVENTION

1. Field of the Invention

The present invention relates to a liquid crystal display, and more particularly to a method and an apparatus for driving a liquid crystal display that is adaptive for improving a picture quality as well as reducing a memory capacity.

2. Discussion of the Related Art

In general, a liquid crystal display (LCD) controls a light transmittance of individual liquid crystal cells in accordance with a video signal, thereby displaying an image. An active matrix LCD including a switching device for each liquid crystal cell is suitable for displaying moving images. The active matrix LCD uses thin film transistor (TFT) as a switching device.

The LCD has a disadvantage in that it has a slow response time due to inherent characteristics of liquid crystals such as viscosity and elasticity, as can be seen from Formulas (1) and (2):

$$\tau_r \propto \gamma d^2/\Delta\epsilon|V_a^2-V_F^2| \quad (1)$$

$$\tau_f \propto \gamma d^2/K \quad (2)$$

wherein $\tau_r$ represents a rising time when a voltage is applied to a liquid crystal; Va represents an applied voltage; VF represents a Frederick transition voltage at which liquid crystal molecules-begin to manifest a tilting motion; d represents a cell gap of liquid crystal cells; $\gamma$ represents a rotational viscosity of the liquid crystal molecules; $\tau_f$ represents a falling time at which a liquid crystal is returned into an initial position by an elastic restoring force after a voltage applied to the liquid crystal is turned off; and K represents an elastic constant.

A twisted nematic (TN) mode liquid crystal has an altered response time due to physical characteristics of the liquid crystal material and the cell gap. Typically, a TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage applied to the liquid crystal cell may change gradually into the next frame before reaching a target voltage. Thus, due to a motion-blurring phenomenon, a moving picture is blurred out on the screen.

FIG. 1 is a waveform diagram representing a brightness variation in accordance with data in a liquid crystal display according to the related art. Referring to FIG. 1, a LCD cannot express desired color and brightness because, upon implementation of a moving picture, a display brightness BL fails to reach a target brightness corresponding to a change of a data VD from one level into other level due to its slow response time. Accordingly, the moving picture suffers from the phenomenon known as motion-blur, and the LCD display quality deteriorates due to reduction of the contrast ratio.

In order to overcome such a slow response time of the LCD, U.S. Pat. No. 5,495,265 and PCT International Publication No. WO99/05567, which are hereby incorporated by reference, have suggested to modulate data in accordance with a difference in the data by using a lookup table (hereinafter referred to as high-speed driving scheme).

FIG. 2 is a waveform diagram representing an example of a brightness variation in accordance with data modulation in a high-speed driving scheme according to the related art. Referring to FIG. 2, a high-speed driving scheme modulates input data VD and applies the modulated data MVD to the liquid crystal cell, thereby obtaining a desired brightness MBL. This high-speed driving scheme increases $|V_a^2-V_F^2|$ from the above Formula (1) on the basis of a difference of the data so that a desired brightness can be obtained in response to a brightness value of the input data within one frame interval, thereby rapidly reducing a response time of the liquid crystal. Accordingly, the LCD employing such a high-speed driving scheme compensates for a slow response time of the liquid crystal by modulating of a data value in order to alleviate a motion-blurring phenomenon in a moving picture, thereby displaying a picture at a desired color and brightness.

FIG. 3 is a diagram representing an example of a high-speed driving scheme in respect of 8-bit data according to the related art. In FIG. 3, a high-speed driving scheme compares most significant bits of the previous frame Fn−1 with those of the current frame Fn to select corresponding modulated data Mdata from the lookup table if there is a change in the most significant bits MSB. This high-speed driving scheme modulates only some of the most significant bits so as to reduce the memory capacity required for hardware implementation.

FIG. 4 is a block diagram representing a high-speed driving apparatus according to the related art. Referring to FIG. 4, a high-speed driving apparatus includes a frame memory 43 connected to the most significant bit bus line 42, and a lookup table 44 commonly connected to the most significant bit bus line 42 and an output terminal of the frame memory 43.

Frame memory 43 may store most significant bit data MSB during one frame interval and supplies the stored data to the lookup table 44. Herein, the most significant bit data MSB may be the most significant 4 bits of the 8-bit source data, RGB-Data-In. Lookup table 44 compares most significant bits MSB of a current frame Fn input from the most significant bit bus line 42 with those of the previous frame Fn−1 input from the frame memory 43, as shown in Table 1 or Table 2, and selects the corresponding modulated data Mdata. The modulated data Mdata are added to least significant bits LSB from a least significant bit bus line 41 to be applied to the LCD. Table 1 shows an example of the lookup table 44 that compares the most significant 4-bits MSB ($2^4$, $2^5$, $2^6$, $2^7$) of the previous frame Fn−1 with those of the current frame Fn and selects the modulated data Mdata in accordance with the result of the comparison.

When the most significant bit data MSB are limited to 4 bits, the lookup table 44 of the high-speed driving scheme may be implemented in accordance with Table 1 and 2.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 2 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 13 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 12 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the foregoing tables, a leftmost column corresponds to the data voltage VDn−1 of the previous frame Fn−1 while the top row corresponds to the data voltage VDn of the current frame Fn. Table 1 provides lookup table information in which the most significant bits (i.e., $2^0$, $2^1$, $2^2$ and $2^3$) are expressed by the decimal number format. Table 2 provides lookup table information in which weighting values (i.e., $2^4$ $2^5$, $2^6$ and $2^7$) of the most significant 4 bits are applied to 8-bit data.

The motivation for modulating the most significant 4-bit data MSB in this manner is for reducing the memory capacity required for implementing lookup table 44. However, while the 4-bit comparison scheme depicted in lookup table 44 helps in reducing the required memory capacity, it leads to a deterioration of the picture quality due to the non-linearity associated with the fact that rather changing gradually, gray levels jump discontinuously from one value to the next.

In order to reduce the picture quality deterioration, the data width of the modulated data stored in lookup table 44 has to be wide enough, and the input source data needs to have all bits, e.g., 8 bits, compared.

Table 3 is an example of a lookup table that compares 8-bits of modulated data Mdata with all 8 bits of the source data.

TABLE 3

| 이전 프레임 \ 현재 프레임 | 0 | 1 | … | 141 | 142 | 143 | 144 | 145 | 146 | 147 | … | 220 | 221 | 222 | 223 | 224 | 225 | 226 | … | 255 |
|---|---|---|---|---|---|---|---|---|---|---|---|---|---|---|---|---|---|---|---|---|
| | 1 | 1 | … | … | … | … | … | … | … | … | … | … | … | … | … | … | … | … | … | … |
| … | … | … | … | … | … | … | … | … | … | … | … | … | … | … | … | … | … | … | … | … |
| 141 | … | … | 141 | 142 | 144 | 145 | 146 | 148 | 149 | … | 244 | 245 | 246 | 247 | 248 | 248 | 249 | … | 255 |
| 142 | … | … | 141 | 142 | 144 | 145 | 146 | 148 | 149 | … | 244 | 245 | 246 | 247 | 248 | 248 | 249 | … | 255 |
| 143 | … | … | 140 | 141 | 143 | 144 | 145 | 147 | 148 | … | 244 | 245 | 246 | 247 | 248 | 248 | 249 | … | 255 |
| 144 | … | … | 140 | 141 | 143 | 144 | 145 | 147 | 148 | … | 244 | 245 | 246 | 247 | 248 | 248 | 249 | … | 255 |
| 145 | … | … | 140 | 141 | 143 | 144 | 145 | 147 | 148 | … | 244 | 245 | 246 | 247 | 248 | 248 | 249 | … | 255 |
| 146 | … | … | 139 | 140 | 142 | 143 | 144 | 146 | 147 | … | 244 | 245 | 246 | 247 | 248 | 248 | 249 | … | 255 |
| … | … | … | … | … | … | … | … | … | … | … | … | … | … | … | … | … | … | … | … | … |
| 221 | … | … | 106 | 108 | 109 | 109 | 111 | 111 | 112 | … | 220 | 221 | 223 | 225 | 226 | 227 | 228 | … | 255 |
| 222 | … | … | 106 | 107 | 108 | 109 | 110 | 111 | 112 | … | 219 | 220 | 222 | 224 | 225 | 227 | 228 | … | 255 |
| 223 | … | … | 105 | 106 | 107 | 108 | 109 | 110 | 111 | … | 218 | 220 | 222 | 223 | 225 | 227 | 228 | … | 255 |
| 224 | … | … | 104 | 105 | 106 | 107 | 108 | 109 | 110 | … | 216 | 218 | 220 | 222 | 224 | 226 | 227 | … | 255 |
| 225 | … | … | 103 | 104 | 105 | 106 | 106 | 107 | 108 | … | 215 | 217 | 219 | 221 | 222 | 225 | 227 | … | 255 |
| 226 | … | … | 102 | 103 | 104 | 105 | 105 | 106 | 107 | … | 213 | 215 | 217 | 220 | 221 | 224 | 226 | … | 255 |
| … | … | … | … | … | … | … | … | … | … | … | … | … | … | … | … | … | … | … | … | … |
| 255 | … | … | 61 | 62 | 62 | 64 | 64 | 65 | 65 | … | 155 | 156 | 157 | 158 | 162 | 165 | 168 | … | 255 |

When the lookup table compares source data using all of the available 8 bits, and the modulated data Mdata pre-stored within the lookup table are 8-bits, since the gray level values change linearly, the picture quality is excellent, whereas the memory capacity increases by leaps and bounds. For instance, if the lookup table compares them by the 8-bits and the modulated data Mdata are 8-bits, the memory capacity of the lookup table is 65,536×8=524,000 bits. Herein, the first term '65,536' of the left side is a product (256×256) of 8-bit source data of the previous frame Fn−1 and those of the current frame Fn, and the second term '8' of the left side is the data width (8-bits) of the modulated data registered within the lookup table 44. Further, if red, green and blue kGB are taken into consideration for implementing color, the required memory capacity of the lookup table is 65,536×8×3=1,5720,000 bits. Accordingly, if the 8-bit comparison scheme is adopted in the lookup table for high-speed driving, since the memory capacity increase, a chip size increases as well as a manufacturing cost.

SUMMARY OF THE INVENTION

Accordingly, the present invention is directed to a method and an apparatus for driving liquid crystal display that substantially obviates one or more of the problems due to limitations and disadvantages of the related art.

An object of the present invention is to provide a method for driving a liquid crystal display that is adaptive for improving a picture quality as well as reducing a memory capacity.

Another object of the present invention is to provide an apparatus for driving a liquid crystal display that is adaptive for improving a picture quality as well as reducing a memory capacity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for driving a liquid crystal display, includes receiving source data, reducing the number of bits of the source data, thereby generating a reduced-bit source data, comparing the reduced-bit source data of a previous frame with the reduced-bit source data of a current frame to select a preset modulated data in accordance with the result of the comparison, and modulating the source data by using the selected modulated data.

In another aspect of the present invention, a method for driving a liquid crystal display, includes setting a first modulated data that has a larger value than a data value of a current frame in accordance with an increase of the data value, setting a second modulated data that has a smaller value than the data value of the current frame in accordance with a decrease of the data value, storing in a storage memory an n-bit source data, wherein n is a positive integer, determining whether a source data of the current frame is identical in n−k bits to a source data of the previous frame stored in the storage memory, wherein k is a positive integer less than n, and supplying the source data of the current frame to a liquid crystal display panel or modulating the source data by using the first and second modulated data in accordance with a result of the judging step.

In another aspect of the present invention, an apparatus for driving a liquid crystal display, includes an input line for receiving source data, a bit converter for reducing the number of bits of the received source data to generate reduced bit source data, and a modulator for comparing the reduced bit source data of a current frame with the reduced bit source data of a previous frame to modulate the source data by using a preset modulated data in accordance with a result of the comparison.

In another aspect of the present invention, an apparatus for driving a liquid crystal display, includes a liquid crystal display panel comprising a plurality of data lines, and a plurality of gate lines, wherein the data lines cross the gate lines, and a liquid crystal cell is formed at a pixel area between a data line and a gate line, an input line for receiving n-bit source data, wherein n is a positive integer, a storage memory for storing the received source data, a comparator for determining whether the source data of a current frame is identical in n−k bits to the source data of a previous frame stored in the storage memory, wherein k is a positive integer less than n, and a modulator for registering a first modulated data that has a larger value than a data value of the current frame in accordance with an increase of the data value, and a second modulated data that has a smaller value than the data value of the current frame in accordance with a decrease of the data value, and supplying the source data of the current frame to the liquid crystal display panel, or modulating the source data by using the first and second modulated data in accordance with a judgment result of the comparator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 5:
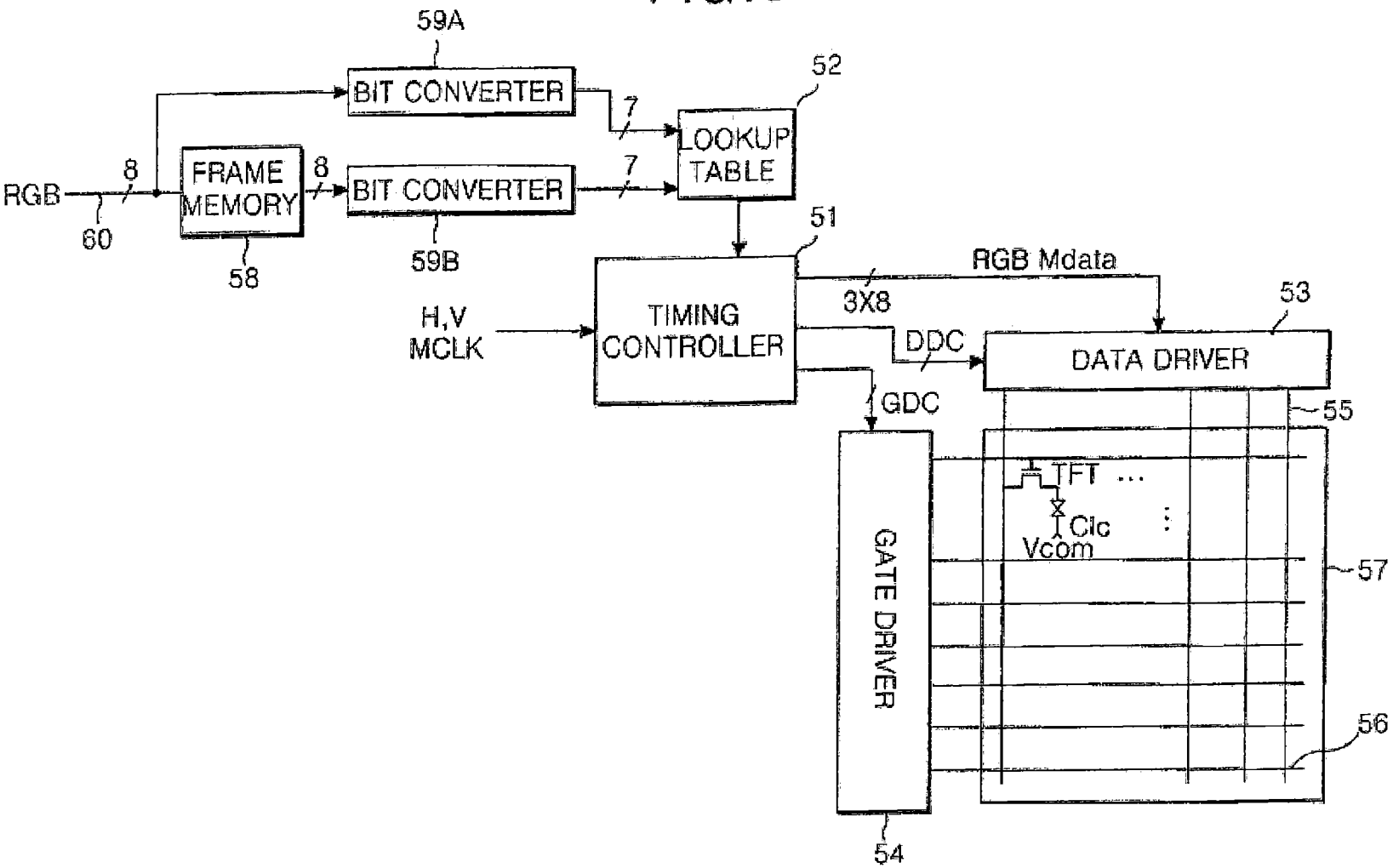
FIG. 5 is a block diagram representing an exemplary apparatus for driving a liquid crystal display according to a first embodiment of the present invention.

FIG. 5 is a block diagram representing an apparatus for driving a liquid crystal display according to a first embodiment of the present invention. Referring to FIG. 5, an apparatus for driving a liquid crystal display (LCD) may include a liquid crystal display panel 57 having data lines 55 and gate lines 56 crossing each other and having a TFT formed at each intersection part thereof to drive a liquid crystal cell Clc, a data driver 53 to supply data to the data lines 55 of the liquid crystal display panel 57, a gate driver 54 to supply scan pulses to the gate lines 56 of the liquid crystal display panel 57, a frame memory 58 connected to an input line 60, a lookup table 52 to modulate the data, a first bit converter 59A installed between the input line 60 and the lookup table 52, a second bit converter 59B installed between the frame memory 58 and the lookup table 52, and a timing controller 51 connected between the lookup table 52 and the data driver 53.

The liquid crystal display panel 57 may have liquid crystals injected between two glass substrates, and the data lines 55 and the gate lines 56 may be formed to perpendicularly cross each other on a lower glass substrate. The TFT provided at the intersection part of the data lines 55 and the gate lines 56 supplies the data through the data lines 55 to the liquid crystal cell Clc in response to the scan pulse from the gate lines 56. To this end, the gate electrode of the TFT may be connected to the gate lines 56 while the source electrode thereof may be connected to the data lines 55. The drain electrode of the TFT may be connected to a pixel electrode of the liquid crystal cell Clc.

The data driver 53 may include a shift register to sample a dot clock of a data control signal DDC, a register to temporarily store data, a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 55 to which the analog data converted by the positive/negative gamma voltage is applied, and an output buffer connected between the multiplexor and the data line. The data driver 53 may be supplied with red (R), green (G), and blue (B) modulated data Mdata modulated by the lookup table 52 and may supply the modulated data Mdata to the data lines 55 of the liquid crystal display panel 57 in response to a data control signal DDC received from the timing controller 51.

The gate driver 54 may include a shift register to sequentially generate scan pulses in response to a gate control signal GDC received from the timing controller 51, and a level shifter to shift a voltage of the scan pulse into a level suitable for driving the liquid crystal cell Clc.

The lookup table 52 may compare the data of a current frame Fn with those of the previous frame, Fn−1 using 7 bits for comparison, and may select the modulated data Mdata in accordance with the result of the comparison. Further detailed description of the lookup table will be explained later.

The timing controller 51 may generate a gate control signal GDC to control the gate driver 54 and a data control signal DDC to control the data driver 53 by using horizontal and vertical synchronization signals H and V and a main clock MCLK. And the timing controller 51 may receive the modulated data Mdata selected by the lookup table 52 and may supply the modulated data Mdata to the data driver 53. The frame memory 58 may store the data from the input line 60 for one frame interval and may supply the stored RGB data to the second bit converter 59B.

Alternatively, an interface circuit may be installed between the input line 60 and the frame memory 58 to reduce data bus lines, wherein the interface circuit may adopt an interface system such as a Low Voltage Differential Signaling LVDS system, a Transition Minimized Differential Signaling TMDS system, or Reduced Swing Differential Signaling RSDS system etc.

The first bit converter 59A may convert the 8-bit data of the current frame supplied from the input line 60 into a 7-bit data to supply the converted 7-bit data to the lookup table 52. The second bit converter 59B may convert the 8-bit data of the previous frame supplied from the frame memory 58 into a 7-bit data to supply the converted 7-bit data to the lookup table 52. Such bit converters 59A and 59B will be further explained later.

The modulated data Mdata stored in lookup table 52 satisfies high-speed driving conditions expressed by Formulas (3) to (5).

$$VDn<VDn-1 \rightarrow MVDn<VDn \quad (3)$$

$$VDn=VDn-1 \rightarrow MVDn=VDn \quad (4)$$

$$VDn>VDn-1 \rightarrow MVDn>VDn \quad (5)$$

In Formulas (3) to (5), VDn−1 represents a data voltage of the previous frame, VDn is a data voltage of the current frame, and MVDn represents a modulated data voltage.

Figure 1:
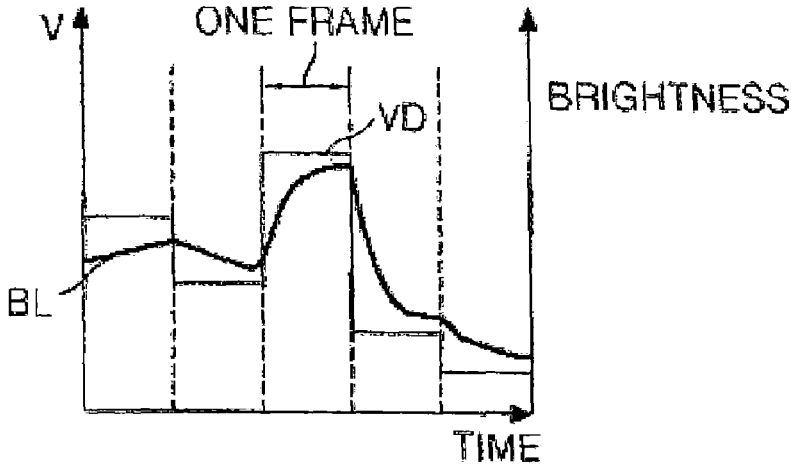
FIG. 1 RELATED ART
FIG. 1 is a waveform diagram representing a brightness variation in accordance with data in a liquid crystal display according to the related art.
Figure 2:
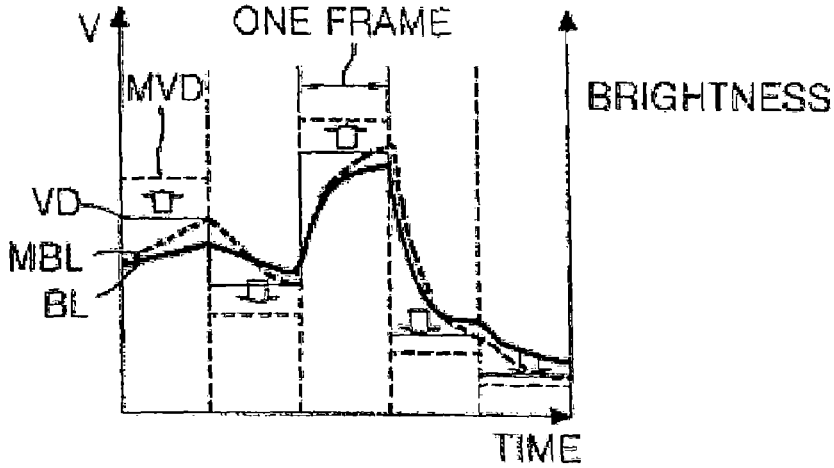
FIG. 2 RELATED ART
FIG. 2 is a waveform diagram representing an example of a brightness variation in accordance with data modulation in a high-speed driving scheme according to the related art.
Figure 3:
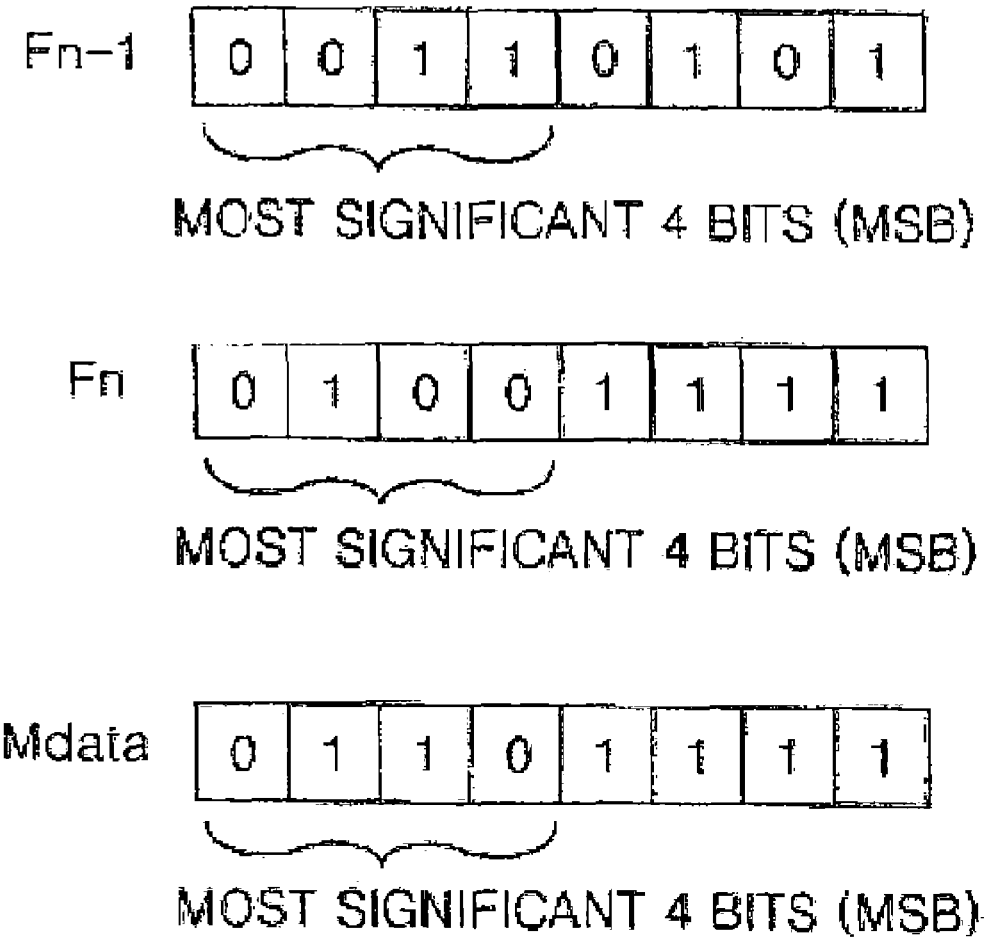
FIG. 3 RELATED ART
FIG. 3 is a diagram representing an example of a high-speed driving scheme in respect of 8-bit data according to the related art.
Figure 4:
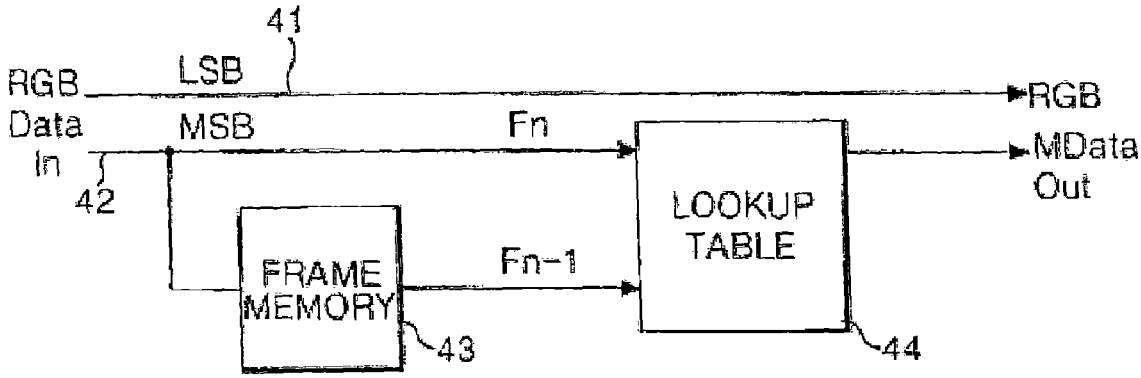
FIG. 4 RELATED ART
FIG. 4 is a block diagram representing a high-speed driving apparatus according to the related art.

Tables 4 and 5 are examples of the lookup table 52. Table 4 shows values that the lookup table 52 may substitute for modulated data values of a modulated data band, wherein the values may be derived by way of converting the source data into the 7-bit data in lookup Table 3, selecting a minimum value in a specific modulated data band that satisfies Formula (3), and selecting a maximum value in a specific modulated data that satisfies Formula (5). Specifically, the source data of Table 3 may be converted into 7-bit data. Accordingly, among the modulated data satisfying Formulas (3) and (5), i.e., four modulated data adjacent to their top/bottom/left/right, the modulated data corresponding to an undershoot may be substituted for the remaining three modulated data. When the source data are modulated to a value a little lower than the optimal modulated data pre-set upon the high-speed driving, there is almost no effect on a subjective picture quality perceived by an observer, but if the source data is modulated to a value higher than the optimal modulated data, there is a sudden change in the brightness of a picture perceived by an observer. Accordingly, as the number of bits of the source data decreases, the appropriate value for the undershoot in specific modulated data may be substituted for the modulated data while maintaining a high-speed driving effect, thereby reducing the number of the modulated data to one fourth thereof. Table 5 shows a re-configured lookup table of FIG. 3 by way of taking one out of two identical adjacent source data from Table 4.

TABLE 4

| | current frame | | | | | | | | | | | | | | | | | | |
|---|---|---|---|---|---|---|---|---|---|---|---|---|---|---|---|---|---|---|---|
| | 0 | 1 ... | 71 | 71 | 72 | 72 | 73 | 73 | 74 ... | 110 | 111 | 111 | 112 | 112 | 113 | 113 ... | 128 |
| | 1 | 1 ... | ... | ... | ... | ... | ... | ... | ... ... | ... | ... | ... | ... | ... | ... | ... ... | ... |
| | ... | ... ... | ... | ... | ... | ... | ... | ... | ... ... | ... | ... | ... | ... | ... | ... | ... ... | ... |
| Previous frame | 71 | ... ... | 141 | 142 | 144 | 144 | 146 | 146 | 149 ... | 244 | 245 | 245 | 247 | 247 | 248 | 248 ... | 255 |
| | 71 | ... ... | 141 | 142 | 144 | 144 | 146 | 146 | 149 ... | 244 | 245 | 245 | 247 | 247 | 248 | 248 ... | 255 |
| | 72 | ... ... | 141 | 141 | 143 | 144 | 145 | 145 | 148 ... | 244 | 245 | 245 | 247 | 247 | 248 | 248 ... | 255 |
| | 72 | ... ... | 141 | 141 | 143 | 144 | 145 | 145 | 148 ... | 244 | 245 | 245 | 247 | 247 | 248 | 248 ... | 255 |
| | 73 | ... ... | 141 | 141 | 144 | 144 | 145 | 147 | 148 ... | 244 | 245 | 245 | 247 | 247 | 248 | 248 ... | 255 |
| | 73 | ... ... | 141 | 141 | 144 | 144 | 144 | 146 | 147 ... | 244 | 245 | 245 | 247 | 247 | 248 | 248 ... | 255 |
| | ... | ... ... | ... | ... | ... | ... | ... | ... | ... ... | ... | ... | ... | ... | ... | ... | ... ... | ... |
| | 111 | ... ... | 108 | 108 | 109 | 109 | 111 | 111 | 112 ... | 220 | 221 | 223 | 224 | 224 | 227 | 227 ... | 254 |
| | 111 | ... ... | 108 | 108 | 109 | 109 | 111 | 111 | 112 ... | 219 | 220 | 222 | 224 | 224 | 227 | 227 ... | 254 |
| | 112 | ... ... | 106 | 106 | 108 | 108 | 110 | 110 | 111 ... | 219 | 222 | 222 | 223 | 225 | 226 | 226 ... | 254 |
| | 112 | ... ... | 106 | 106 | 108 | 108 | 110 | 110 | 110 ... | 216 | 222 | 222 | 222 | 224 | 226 | 226 ... | 254 |
| | 113 | ... ... | 104 | 104 | 106 | 106 | 107 | 107 | 108 ... | 216 | 219 | 219 | 222 | 222 | 225 | 225 ... | 254 |
| | 113 | ... ... | 104 | 104 | 106 | 106 | 107 | 107 | 107 ... | 214 | 219 | 219 | 222 | 222 | 224 | 224 ... | 254 |
| | ... | ... ... | ... | ... | ... | ... | ... | ... | ... ... | ... | ... | ... | ... | ... | ... | ... ... | ... |
| | 128 | ... ... | 62 | 62 | 64 | 64 | 65 | 65 | 66 ... | 155 | 157 | 157 | 162 | 162 | 168 | 168 ... | 255 |

Figure 6:
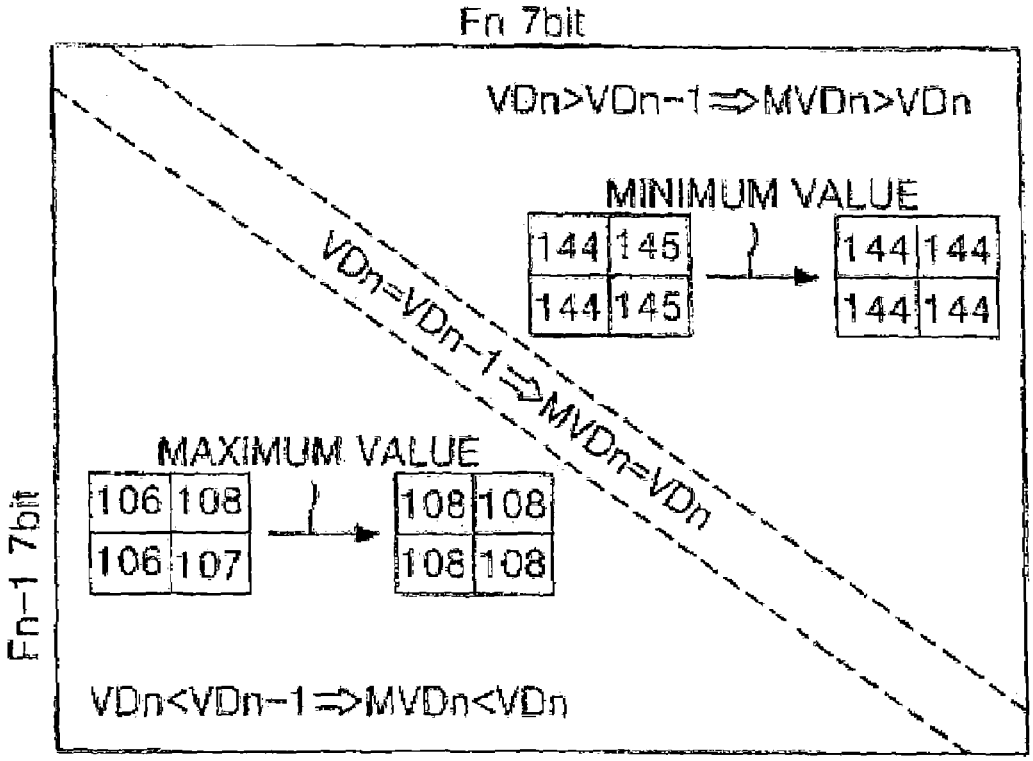
FIG. 6 is a diagram representing an exemplary method for setting modulated data for the lookup table shown in FIG. 5 according to the present invention.

When comparing Table 3 with Table 4, a small band '106, 108, 106, 107' satisfying Formula (3) in the lookup table 52 is converted into the undershoot value, i.e., maximum value (108, 108, 108, 108), as in FIG. 6. Further, a conventional small band '144, 145, 144, 145' is converted into the undershoot value, i.e., minimum value (144, 144, 144, 144), as depicted in FIG. 6.

TABLE 5

| | current frame | | | | | | | | | | | | |
|---|---|---|---|---|---|---|---|---|---|---|---|---|---|
| previous frame | | | | | | | | | | | | | |
| 0 | 1 | . . . | 71 | 72 | 73 | 74 | . . . | 110 | 111 | 112 | 113 | . . . | 128 |
| 1 | 1 | . . . | . . . | . . . | . . . | . . . | . . . | . . . | . . . | . . . | . . . | . . . | . . . |
| . . . | . . . | . . . | . . . | . . . | . . . | . . . | . . . | . . . | . . . | . . . | . . . | . . . | . . . |
| 71 | . . . | . . . | 141 | 144 | 146 | 149 | . . . | 244 | 245 | 247 | 248 | . . . | 255 |
| 72 | . . . | . . . | 141 | 143 | 145 | 148 | . . . | 244 | 245 | 247 | 248 | . . . | 255 |
| 73 | . . . | . . . | 141 | 144 | 145 | 148 | . . . | 244 | 245 | 247 | 248 | . . . | 255 |
| . . . | . . . | . . . | . . . | . . . | . . . | . . . | . . . | . . . | . . . | . . . | . . . | . . . | . . . |
| 111 | . . . | . . . | 108 | 109 | 111 | 112 | . . . | 220 | 221 | 224 | 227 | . . . | 254 |
| 112 | . . . | . . . | 106 | 108 | 110 | 111 | . . . | 219 | 222 | 223 | 226 | . . . | 254 |
| 113 | . . . | . . . | 104 | 106 | 107 | 108 | . . . | 216 | 219 | 222 | 225 | . . . | 254 |
| . . . | . . . | . . . | . . . | . . . | . . . | . . . | . . . | . . . | . . . | . . . | . . . | . . . | . . . |
| 128 | . . . | . . . | 62 | 64 | 65 | 66 | . . . | 155 | 157 | 162 | 168 | . . . | 255 |

Figure 7:
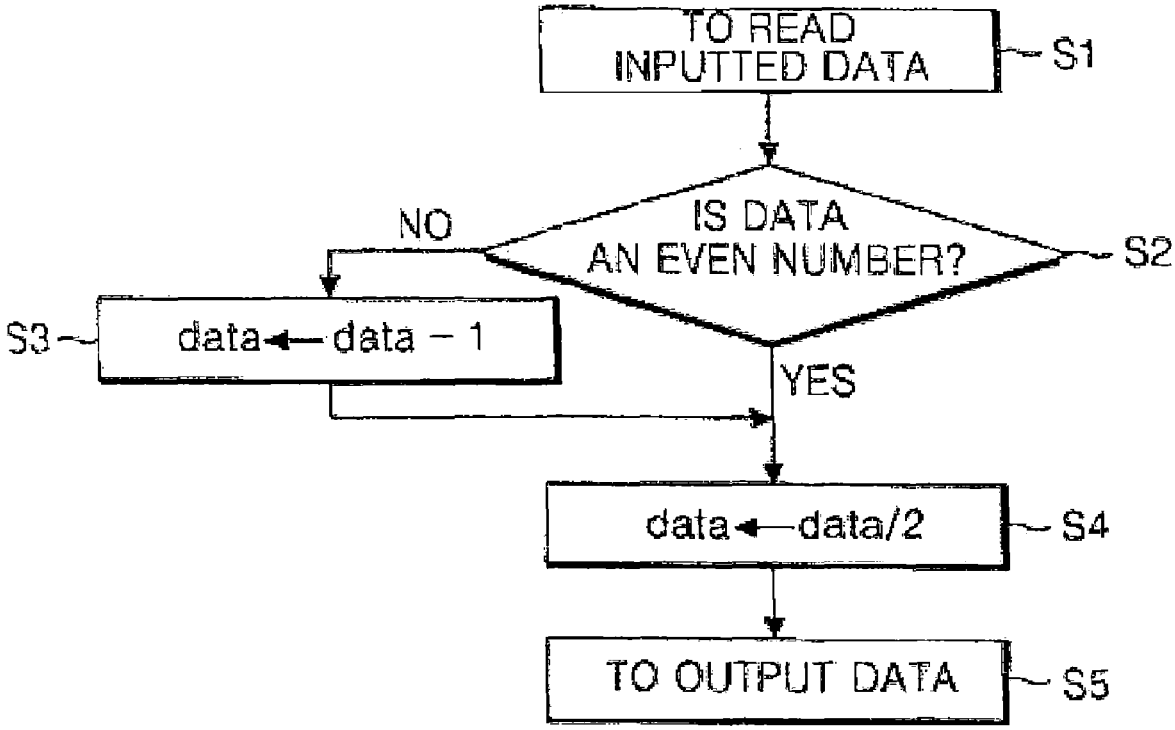
FIG. 7 is a flow chart representing an exemplary control sequence of a bit converter shown in FIG. 5 step by step according to the present invention.

Each of the first and second bit converters 59A and 59B may change the in accordance with a control sequence as in FIG. 7. Referring to FIG. 7, t and second bit converters 59A and 59B may read the 8-Bit source data input line 60 or the frame memory 58 (step S1). If the value of the 8-bit an even number, each of the first and second bit converters 59A and 59B even data by '2' and may convert the divided data into a 7-bit data (step ch of the first and second bit converters 59A and 59B may supply the to the lookup table 52.

If the value of the 8-bit source data is an odd number in the step S1, each of the first and second converters 59A and 59B may subtract '1' from the odd data to turn the odd data into an even data (steps S2 and S3). Subsequently, in step S4, each of the first and second converters 59A and 59B may divide the converted 8-bit even data by '2' and may convert the divided data into the 7-bit data, then may supply the converted 7-bit data (in step S5)to the lookup table 52.

For example, the first and second bit converters 59A and 59B may convert the data into '64' if an 8-bit source data is '128', and may convert the data into '64' if the 8-bit source data is '129'. Accordingly, when converting the 8-bit source data into the 7-bit data, the first and second bit converters 59A and 59B may convert the adjacent even source data and odd source data into the same value within a scope of values that can be expressed with-7-bits.

Figure 8:
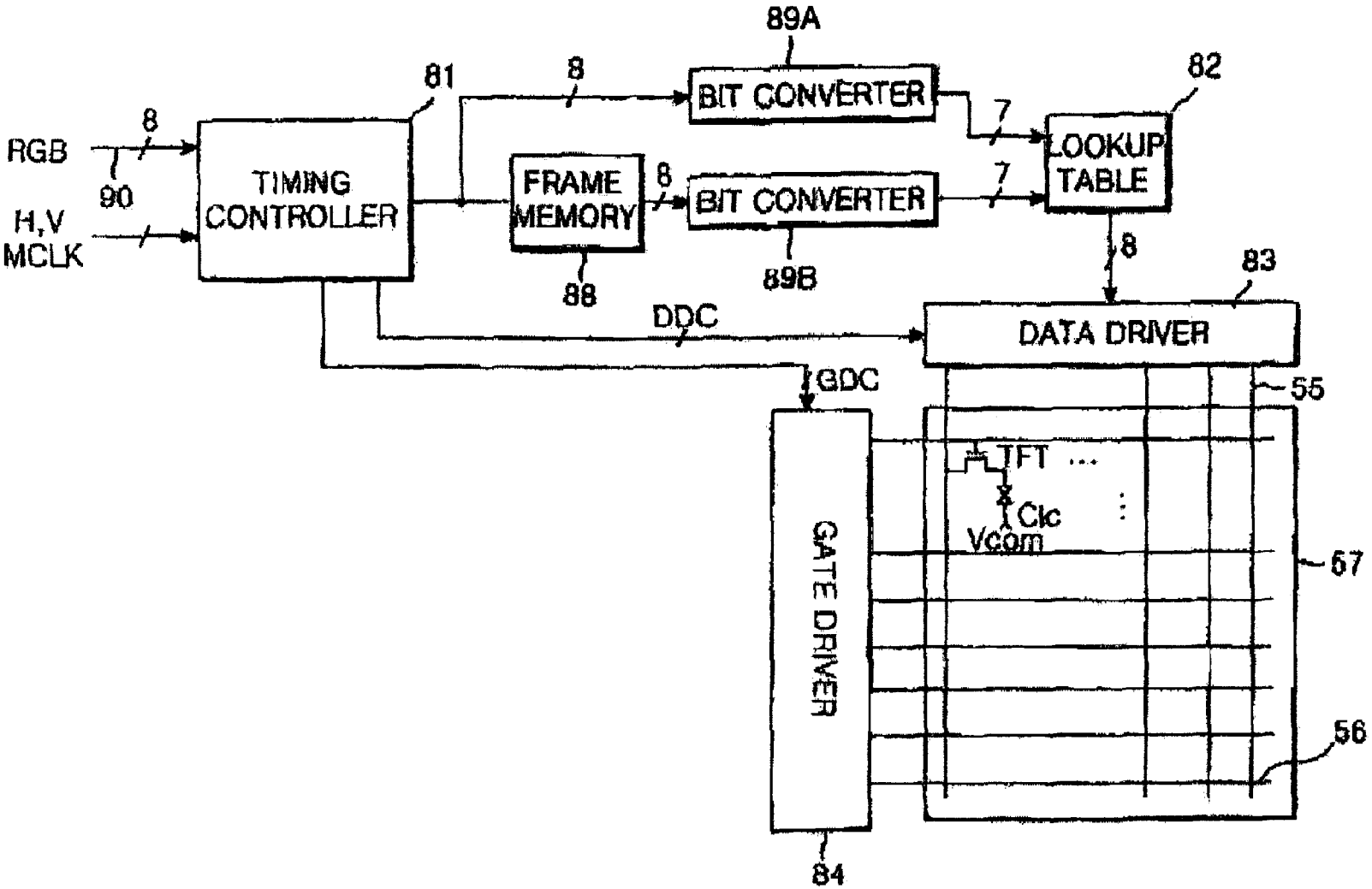
FIG. 8 is a block diagram representing an exemplary apparatus for driving a liquid crystal display according to a second embodiment of the present invention.

FIG. 8 is a block diagram representing an exemplary apparatus for driving a liquid crystal display according to a second embodiment of the present invention. Referring to FIG. 8, the apparatus for driving the liquid crystal display may include a liquid crystal display panel 57 having data lines 55 and gate lines 56 crossing each other and having a TFT formed at each intersection part thereof to drive a liquid crystal cell Clc, a data driver 83 to supply data to the data lines 55 of the liquid crystal display panel 57, a gate driver 84 to supply scan pulses to the gate lines 56 of the liquid crystal display panel 57, a timing controller 81 to which RGB data from an input line 90, synchronization signals H/V and main clock signals MCLK are input, a frame memory 88 connected between the timing controller 81 and the data driver 83, bit converters 89A and 89B, and a lookup table 82.

The liquid crystal display panel 57 may be substantially the same as that shown in FIG. 5, thus the same reference numerals are used and detailed description will be omitted. The data driver 83 may include a shift register to sample a dot clock of a data control signal DDC, a register to temporarily store data, a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 55 to which the analog data converted by the positive/negative gamma voltage is applied, and an output buffer connected between the multiplexor and the data line. The data driver 83 may be supplied with red (R), green (G), and blue (B) modulated data Mdata modulated by the lookup table 82 and may supply the modulated data Mdata to the data lines 55 of the liquid crystal display panel 57 in response to a data control signal DDC from the timing controller 81.

The gate driver 84 may include a shift register to sequentially generate scan pulses in response to a gate control signal GDC received from the timing controller 81, and a level shifter to shift a voltage of the scan pulse into a level suitable for driving the liquid crystal cell Clc.

The timing controller 81 may generate a gate control signal GDC to control the gate driver 84 and a data control signal DDC to control the data driver 83 by using horizontal and vertical synchronization signals H and V and a main clock MCLK. And the timing controller 81 may re-align the RGB data from the input line by a one-channel or two-channel scheme and may supply the re-aligned data to the frame memory 88 and the first bit converter 89A. In comparison with the one-channel scheme, a drive frequency may be lowered more in the two-channel scheme where the timing controller 81 simultaneously outputs odd-RGB data and even RGB data.

The frame memory 88 may store the data from the timing controller 81 for one frame interval and may supply the stored RGB data to the second bit converter 89B. The first bit converter 89A may convert the 8-bit data of the current frame supplied from the timing controller 81 into a bit source data by using an algorithm as in FIG. 7, and may supply the converted 7-bit source data to the lookup table 82. The second bit converter 89B may convert the 8-bit data of the previous frame supplied from the frame memory 88 into a 7-bit source data, and may supply the converted 7-bit source data to the lookup table 82.

The lookup table 82 may be connected between the bit converters 89A and 89B and the data driver 83 for comparing the 7-bit data of the current frame Fn and the 7-bit data of the previous frame Fn−1 to select the modulated data Mdata in accordance with the result of the comparison. The lookup table 82, as the number of bits of the source data is reduced to 7-bits as in Table 4 and 5 and FIG. 6, may substitute the undershoot for the other values in a specific data band.

An interface circuit may be installed between the input line 90 and the timing controller 81 to reduce data bus lines, wherein the interface circuit may adopt an interface system, such as a Low Voltage Differential Signaling LVDS system, a Transition Minimized Differential Signaling TMDS system, or Reduced Swing Differential Signaling RSDS system etc.

In the apparatus for driving the liquid crystal display according to the first and second embodiments of the present invention, if the resolution of the liquid crystal display is 1024×768, a comparison of the 8-bit high-speed driving scheme of the present invention with the 8-bit high speed driving scheme of the related art in the data width of the input data received through the input line, the data width of the output data supplied from the lookup table 52 and 82, the memory capacity of the lookup table 52 and 82, and the memory capacity of the frame memory 58 and 88, is shown in Table 6.

Referring to Table 6, in the apparatus for driving the liquid crystal display according to the first and second embodiments of the present invention, the memory capacity of the lookup table 52 and 82 may be reduced to 0.13 Mbits and even though red, green and blue RGB are taken into consideration, the memory capacity of the lookup table may be no more than 0.39 Mbits.

TABLE 6

| Classification | data width of input data | memory capacity of lookup table | memory capacity of frame memory | data width of output data |
|---|---|---|---|---|
| 8-bit high-speed driving scheme of the related art | 8 bits | The number of addresses of source data: $2^8 \times 2^8 = 2^{16}$ Data width of modulated data: 8 $\rightarrow 2^{16} \times 8 = 0.52$ Mbits | The number of pixels: 1024 × 768 × 3(RGB) data width: 8 ->18.87 Mbits | 8 bits |
| First and second embodiments of the present invention | 8 bits | The number of addresses of source data: $2^7 \square 2^7 = 2^{14}$ Data width of modulated data: 8 $\rightarrow 2^{14} \times 8 = 0.13$ Mbits | The number of pixels: 1024 × 768 × 3(RGB) data width: 8 ->18.87 Mbits | 8 bits |

Figure 9:
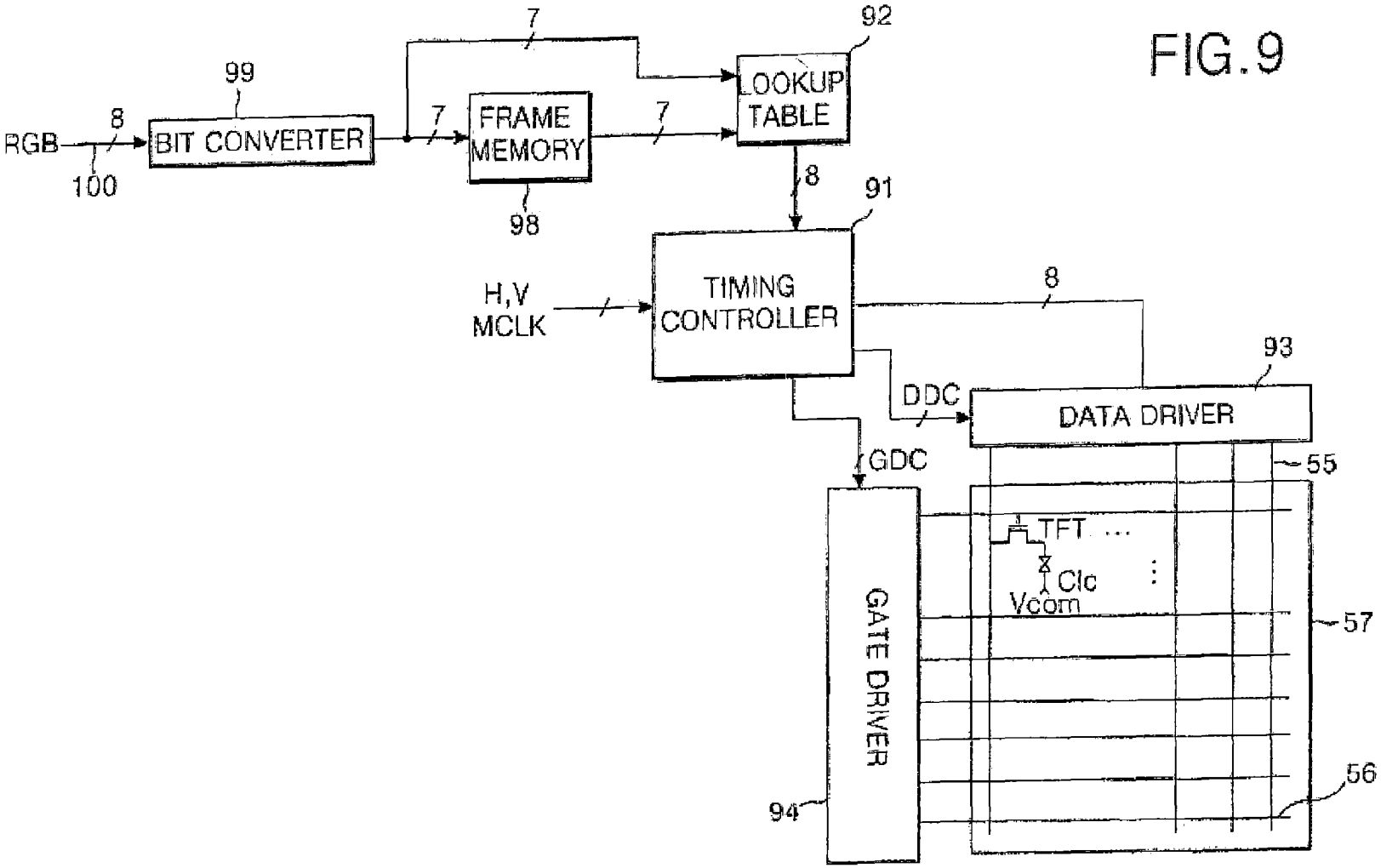
FIG. 9 is a block diagram representing an exemplary apparatus for driving a liquid crystal display according to a third embodiment of the present invention.

FIG. 9 represents an exemplary apparatus for driving a liquid crystal display according to the third embodiment of the present invention. Referring to FIG. 9, an apparatus for driving the liquid crystal display may include a liquid crystal display panel 57 having data lines 55 and gate lines 56 crossing each other and having a TFT formed at each intersection part thereof to drive a liquid crystal cell Clc, a data driver 93 to supply data to the data lines 55 of the liquid crystal display panel 57, a gate driver 94 to supply scan pulses to the gate lines 56 of the liquid crystal display panel 57, a timing controller 91 to control the data driver 93 and the gate driver 94, a bit converter 99, a frame memory 98, and a lookup table 92 connected between an input line 100 and the timing controller 91.

The data driver 93 may include a shift register to sample a dot clock of a data control signal DDC, a register to temporarily store data, a latch to store the data by lines and to simultaneously output the stored data of one line in response to the clock signal from the shift register, a digital-to-analog converter to select a positive/negative gamma voltage in correspondence to the digital data value received from the latch, a multiplexor to select a data line 55 to which the analog data converted by the positive/negative gamma voltage is applied, and an output buffer connected between the multiplexor and the data line. The data driver 93 may be supplied with red (R) green (G), and blue (B) modulated data Mdata modulated by the lookup table 92 and may supply the modulated data Mdata to the data lines 55 of the liquid crystal display panel 57 in response to a data control signal DDC from the timing controller 91.

The gate driver 94 may include a shift register to sequentially generate scan pulses in response to a gate control signal GDC received from the timing controller 91, and a level shifter to shift a voltage of the scan pulse into a level suitable for driving the liquid crystal cell Clc.

The lookup table 92 may compare the 7-bit data of the current frame Fn and the 7-bit data of the previous frame Fn−1 to select the modulated data Mdata in accordance with the result of the comparison. The lookup table 92, as the number of bits of the source data is reduced to 7-bits as in Table 4 and 5 and FIG. 6, may substitute the undershoot for the other values in a specific data band.

The timing controller 91 may generate a gate control signal GDC to control the gate driver 94 and a data control signal DDC to control the data driver 93 by using horizontal and vertical synchronization signals H and V and a main clock-MCLK. And the timing controller 91 may receive the modulated data Mdata selected by the lookup table 92, and may supply the selected modulated data Mdata to the data driver 93.

The bit converter 99 may convert the 8-bit data input from the input line 100 into a 7-bit data by using an algorithm as in FIG. 7, and may supply the converted 7-bit data as the current frame data to the lookup table 92 and the frame memory 98. The frame memory 98 may store the 7-bit data from the bit converter 99 for one frame interval and may supply the stored RGB data as the previous frame data to the lookup table 92.

An interface circuit may be installed between the input line 100 and the bit converter 99 to reduce data bus lines, wherein the interface circuit may adopt an interface system such as a Low Voltage Differential Signaling LVDS system, a Transition Minimized Differential Signaling TMDS system, or Reduced Swing Differential Signaling RSDS system etc.

Figure 10:
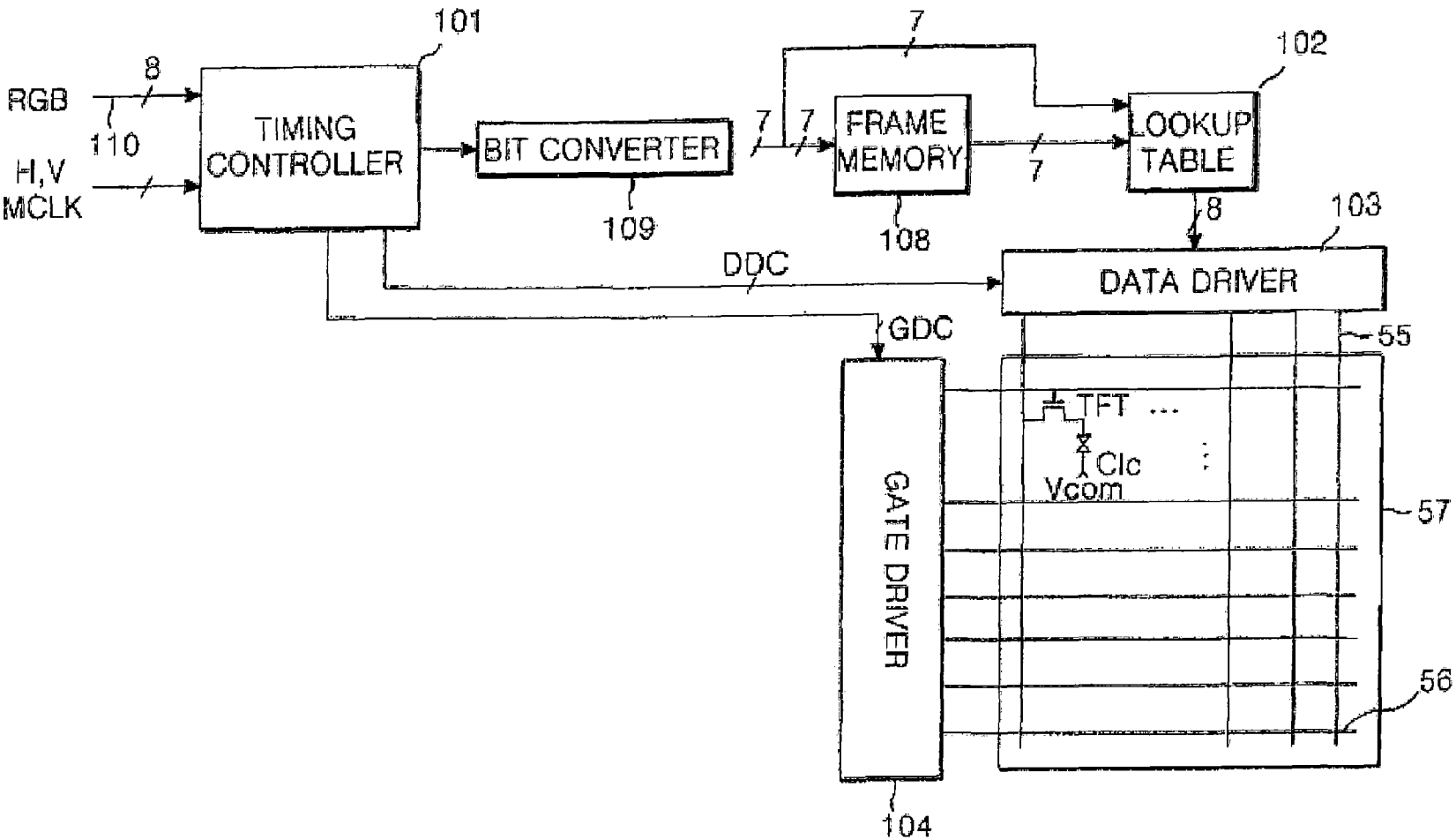
FIG. 10 is a block diagram representing an exemplary apparatus for driving a liquid crystal display according to a fourth embodiment of the present invention.

FIG. 10 represents an exemplary apparatus for driving a liquid crystal display according to a fourth embodiment of the present invention. Referring to FIG. 10, an apparatus for driving the liquid crystal display may include a liquid crystal display panel 57 having data lines 55 and gate lines 56 crossing each other and having a TFT formed at each intersection part thereof to drive a liquid crystal cell Clc, a data driver 103 to supply data to the data lines 55 of the liquid crystal display panel 57, a gate driver 104 to supply scan pulses to the gate lines 56 of the liquid crystal display panel 57, a timing controller 101 to which RGB data, synchronization signals H/V and main clock signals MCLK, a bit converters 109, a frame memory 108, and a lookup table 102 connected between the timing controller 101 and the data driver 103.

The data driver 103 may include a shift register to sample a dot clock of a data control signal DDC, a register to temporarily store data, a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 55 to which the analog data converted by the positive/negative gamma voltage is applied, and an output buffer connected between the multiplexor and the data line. The data driver 103 may be supplied with red (R), green (G), and blue (B) modulated data Mdata modulated by the lookup table 102 and may supply the modulated data Mdata to the data lines 55 of the liquid crystal display panel 57 in response to a data control signal DDC received from the timing controller 101.

The gate driver 104 may include a shift register to sequentially generate scan pulses in response to a gate control signal GDC received from the timing controller 101, and a level shifter to shift a voltage of the scan pulse into a level suitable for driving the liquid crystal cell Clc.

The timing controller 101 may generate a gate control signal GDC to control the gate driver 104 and a data control signal DDC to control the data driver 103 by using horizontal and vertical synchronization signals H and V and a main clock MCLK. And the timing controller 101 may re-align the RGB data received from the input line by a one-channel or two-channel scheme and may supply the re-aligned data to the bit converter 109.

The bit converter 109 may convert the 8-bit data input from the timing controller 101 into a 7-bit source data by using an algorithm as in FIG. 7, and may supply the converted 7-bit source data to the lookup table 102 and the frame memory 108.

The frame memory 108 may store the 7-bit data received from the bit converter 109 for one frame interval and may supply the stored 7-bit data as the previous frame data to the lookup table 102.

The lookup table 102 may be connected to the bit converter 109, the frame memory 108, and the data driver 103 for comparing the 7-bit data of the current frame Fn and the 7-bit data of the previous frame Fn−1 to select the modulated data Mdata in accordance with the result of the comparison. The lookup table 102, as the number of bits of the source data is reduced to 7-bits as in Table 4 and 5 and FIG. 6, may substitute the undershoot for the other values in a specific data band.

An interface circuit may be installed between the input line 110 and the timing controller 101 to reduce data bus lines, wherein the interface circuit may adopt an interface system, such as a Low Voltage Differential Signaling LVDS system, a Transition Minimized Differential Signaling TMDS system, or Reduced Swing Differential Signaling. RSDS system etc.

In the apparatus for driving the liquid crystal display according to third and fourth embodiments of the present invention, if the resolution of the liquid crystal display is 1024×768, a comparison of the 8-bit high-speed driving scheme of the present invention with the conventional 8-bit high speed driving scheme in the data width of the input data received through the input line, the data width of the output data supplied from the lookup table 92 and 102, the memory capacity of the lookup table 92 and 102, and the memory capacity of the frame memory 98 and 108, is shown in Table 7.

Referring to Table 7, in the apparatus for driving the liquid crystal display according to the third and fourth embodiments of the present invention, the memory capacity of the lookup table 92 and 102 may not only be reduced to 0.13 Mbits, but the memory capacity of the frame memory 98 and 108 may also be reduced to 16.52 Mbits because the number of bits of the data input to the frame memory 98 and 108 may be reduced to 7-bits.

TABLE 7

| Classification | data width of input data | memory capacity of lookup table | memory capacity of frame memory | data width of output data |
|---|---|---|---|---|
| 8-bit high-speed driving scheme of the related art | 8 bits | The number of addresses of source data: $2^8 \times 2^8 = 2^{16}$ Data width of modulated data: 8 ->$2^{16} \times 8 = 0.52$ Mbits | The number of pixels: 1024 × 768 × 3 (RGB) data width: 8 ->18.87 Mbits | 8 bits |
| Third and fourth embodiments of the present invention | 8 bits | The number of addresses of source data: $2^7 \times 2^7 = 2^{14}$ Data width of modulated data: 8 ->$2^{14} \times 8 = 0.13$ Mbits | The number of pixels: 1024 × 768 × 3 (RGB) data width: 7 ->16.52 Mbits | 8 bits |

The scheme of installing the bit converter before the frame memory in order to reduce the memory capacity of the frame memory in the third and fourth embodiments may also be applicable to the first and second embodiment of the present invention.

Figure 11:
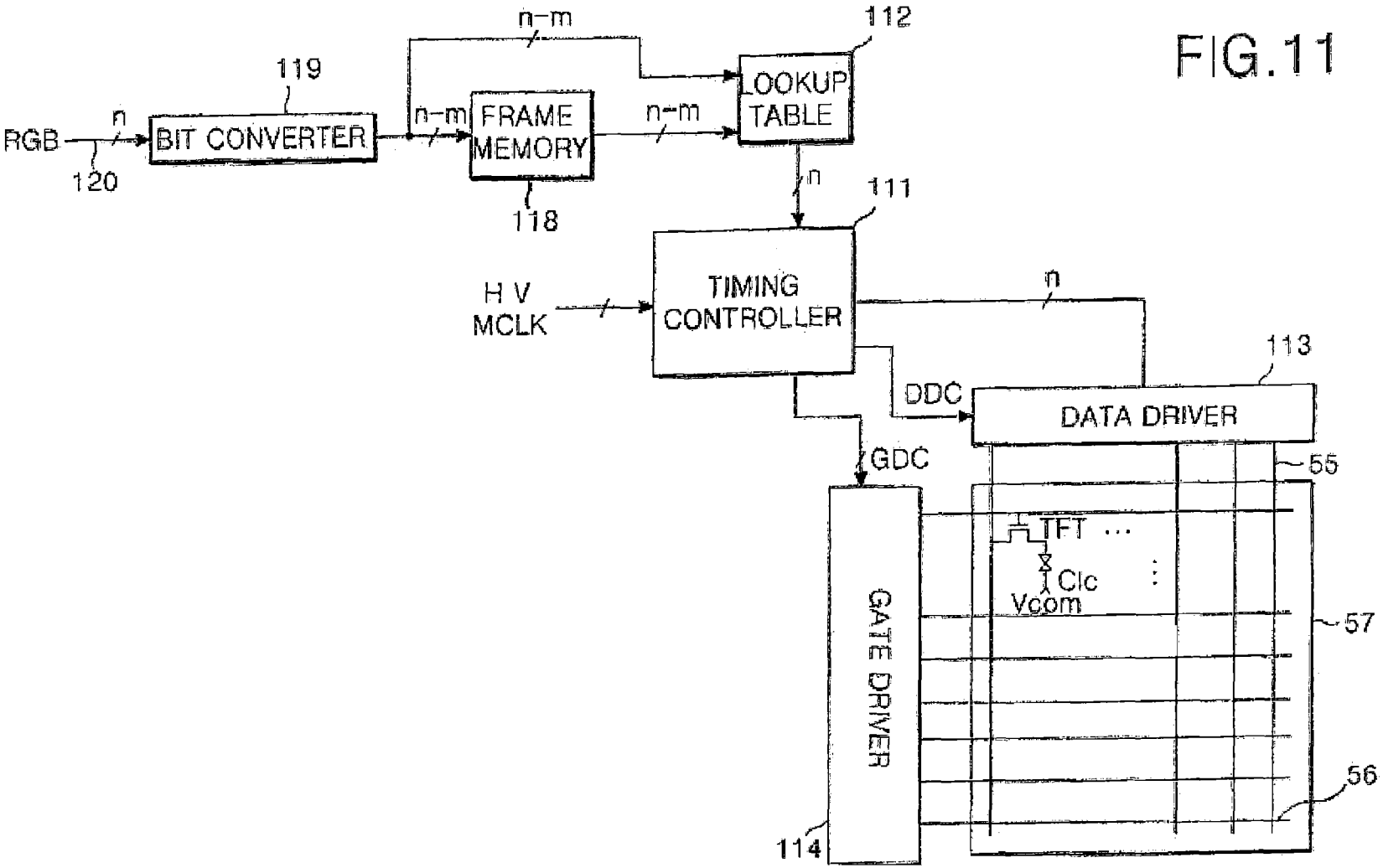
FIG. 11 is a block diagram representing an exemplary apparatus for driving a liquid crystal display according to a fifth embodiment of the present invention.

FIG. 11 represents an exemplary apparatus for driving a liquid crystal display according to a fifth embodiment of the present invention. Referring to FIG. 11, an apparatus for driving the liquid crystal display may include a liquid crystal display panel 57 having data lines 55 and gate lines 56 crossing each other and having a TFT formed at each intersection part thereof to drive a liquid crystal cell Clc, a data driver 113 to supply data to the data lines 55 of the liquid crystal display panel 57, a gate driver 114 to supply scan pulses to the gate lines 56 of the liquid crystal display panel 57, a timing controller 111 to control the data driver 113 and the gate driver 114, a bit converter 119 to convert n-bit data from an input line 120 into (n−m) bit data, and a frame memory 118 and a lookup table 112 connected between the bit converter 119 and the timing controller 111.

The data driver 113 may include a shift register to sample a dot clock of a data control signal DDC; a register to temporarily store data, a latch to store the data by lines and to simultaneously output the stored data of one line in response to the clock signal from the shift register, a digital-to-analog converter to select a positive/negative gamma voltage in correspondence to the digital data value from the latch; a multiplexor to select a data line 55 to which the analog data converted by the positive/negative gamma voltage is applied, and an output buffer connected between the multiplexor and the data line. The data driver 113 may be supplied with red (R), green (G), and blue (B) modulated data Mdata modulated by the lookup table 112 and may supply the modulated data Mdata to the data lines 55 of the liquid crystal display panel 57 in response to a data control signal DDC from the timing controller 111.

The gate driver 114 may include a shift register to sequentially generate scan pulses in response to a gate control signal GDC received from the timing controller 111, and a level shifter to shift a voltage of the scan pulse into a level suitable for driving the liquid crystal cell Clc.

The lookup table 112 may compare the (n−m) bit data (provided m is a positive integer less than n) of the current frame Fn and the (n−m) bit data of the previous frame Fn−1 to select the modulated data Mdata in accordance with the result of the comparison. The modulated data stored at the lookup table 112 may be experimentally determined to satisfy Formulas (3) to (5).

The timing controller 111 may generate a gate control signal GDC to control the gate driver 114 and a data control signal DDC to control the data driver 113 by using horizontal and vertical synchronization signals H and V and a main clock MCLK. And the timing controller 111 may receive the modulated data Mdata selected by the lookup table 112, and may supply the modulated data Mdata to the data driver 113.

The bit converter 119 may convert the n-bit data input from the input line 120 into a (n−m) bit data and may supply the converted (n−n) bit data as the current frame data to the lookup table 112 and the frame memory 118. Herein, 'n' is a positive integer greater than '0' and 'm', i.e., '6' or '8', that are used as an input data bit in the liquid crystal display. A detailed description on this bit converter 119 will be followed in conjunction with FIG. 13.

The frame memory 118 may store the (n−n) bit data from the bit converter 119 for one frame interval and may supply the stored (n−n) bit data as the previous frame data to the lookup table 112.

An interface circuit may be installed between the input line 120 and the bit converter 119 to reduce data bus lines, wherein the interface circuit may adopt an interface system, such as a Low Voltage Differential Signaling LVDS system, a Transition Minimized Differential Signaling TMDS system, or Reduced Swing Differential Signaling RSDS system etc.

Figure 12:
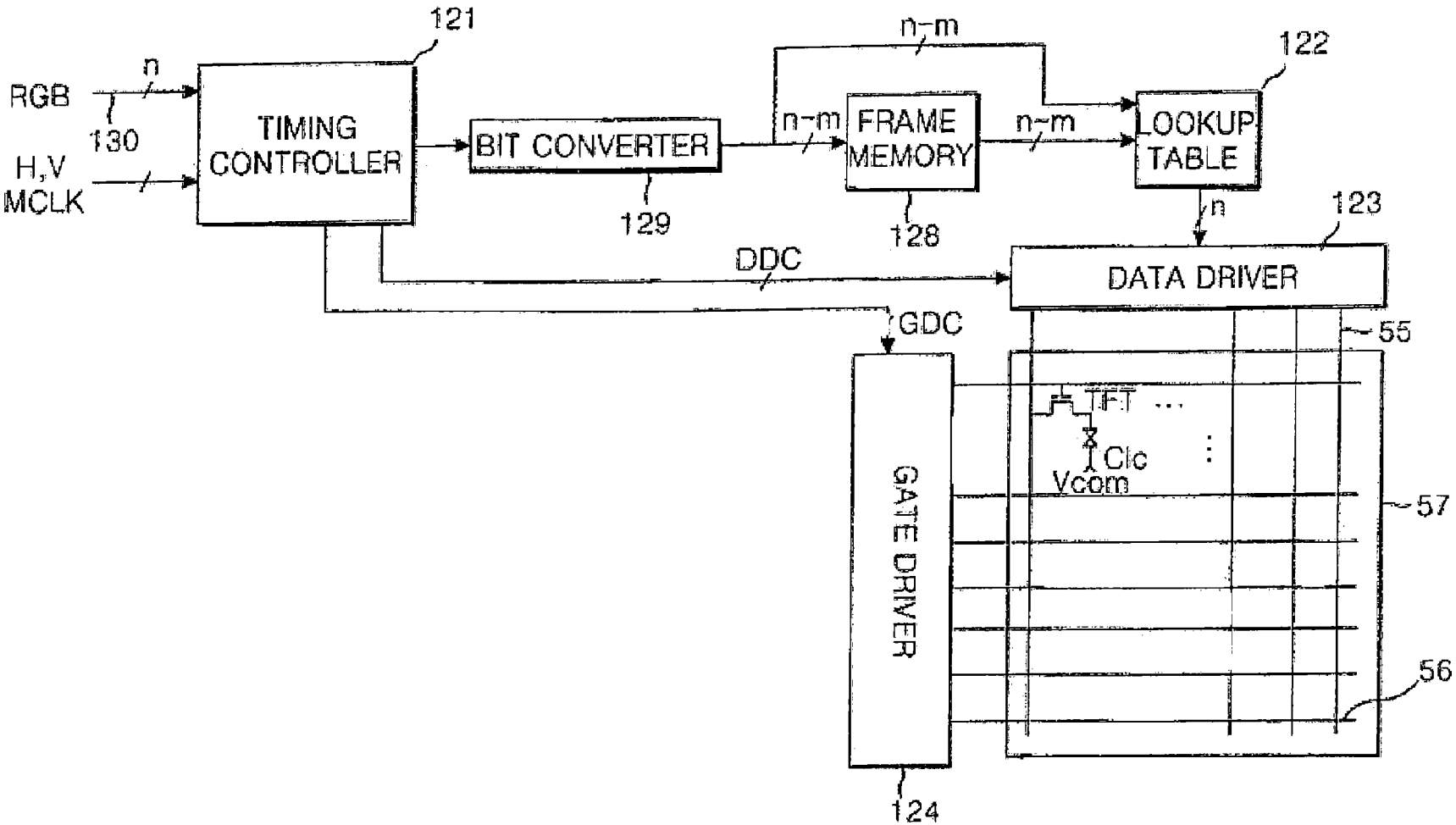
FIG. 12 is a block diagram representing an exemplary apparatus for driving a liquid crystal display according to a sixth embodiment of the present invention.

FIG. 12 represents an exemplary apparatus for driving a liquid crystal display according to a sixth embodiment of the present invention. Referring to FIG. 12, an apparatus for driving the liquid crystal display may include a liquid crystal display panel 57 having data lines 55 and gate lines 56 crossing each other and having a TFT formed at each intersection part thereof to drive a liquid crystal cell Clc, a data driver 123 to supply data to the data lines 55 of the liquid crystal display panel 57, a gate driver 124 to supply scan pulses to the gate lines 56 of the liquid crystal display panel 57, a timing controller 121 to which RGB data, synchronization signals H/V and main clock signals MCLK are input, a bit converter 129 to convert n-bit data from the timing controller 121 into (n−n) bit data, a frame memory 128, and a lookup table 122 connected between the bit converter 129 and the data driver 123.

The data driver 123 may include a shift register to sample a dot clock of a data control signal DDC, a register to temporarily store data, a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 55 to which the analog data converted by the positive/negative gamma voltage is applied, and an output buffer connected between the multiplexor and the data line. The data driver 123 may be supplied with red (R), green (G), and blue (B) modulated data Mdata modulated by the lookup table 122 and may supply the modulated data Mdata to the data lines 55 of the liquid crystal display panel 57 in response to a data control signal DDC from the timing controller 121.

The gate driver 124 may include a shift register to sequentially generate scan pulses in response to a gate control signal GDC received from the timing controller 121, and a level shifter to shift a voltage of the scan pulse into a level suitable for driving the liquid crystal cell Clc.

The timing controller 121 may generate a gate control signal GDC to control the gate driver 124 and a data control signal DDC to control the data driver 123 by using horizontal and vertical synchronization signals H and V and a main clock MCLK. And the timing controller 121 may re-align the RGB data received from an input line 130 by a one-channel or two-channel scheme, and may supply the re-aligned data to the bit converter 129.

The bit converter 129 may convert the n-bit data input from the timing controller 121 into a (n−m) bit data and may supply the converted (n−m) bit data to the frame memory 128 and the lookup table 122. Herein, 'n' is a positive integer greater than '0' and 'm', i.e., '6' or '8' that are used as an input data bit in the liquid crystal display. A detailed description on this bit converter 119 will be followed in conjunction with FIG. 13.

The frame memory 128 may store the (n−m) bit data received from the bit converter 129 for one frame interval and may supply the stored (n−n) bit data as the previous frame data to the lookup table 122.

The lookup table 122 may be connected between the bit converter 129, the frame memory 128 and the data driver 123 for comparing the (n−m) bit data of the current frame Fn and the (n−m) bit data of the previous frame Fn−1 to select the modulated data Mdata in accordance with the result of the comparison. The modulated data stored at the lookup table 122 may be experimentally determined to satisfy Formulas (3) to (5).

An interface circuit may be installed between the input line 130 and the timing controller 121 to reduce data bus lines, wherein the interface circuit may adopt an interface system, such as a Low Voltage Differential Signaling LVDS system, a Transition Minimized Differential Signaling TMDS system, or Reduced Swing Differential Signaling RSDS system etc.

Figure 13:
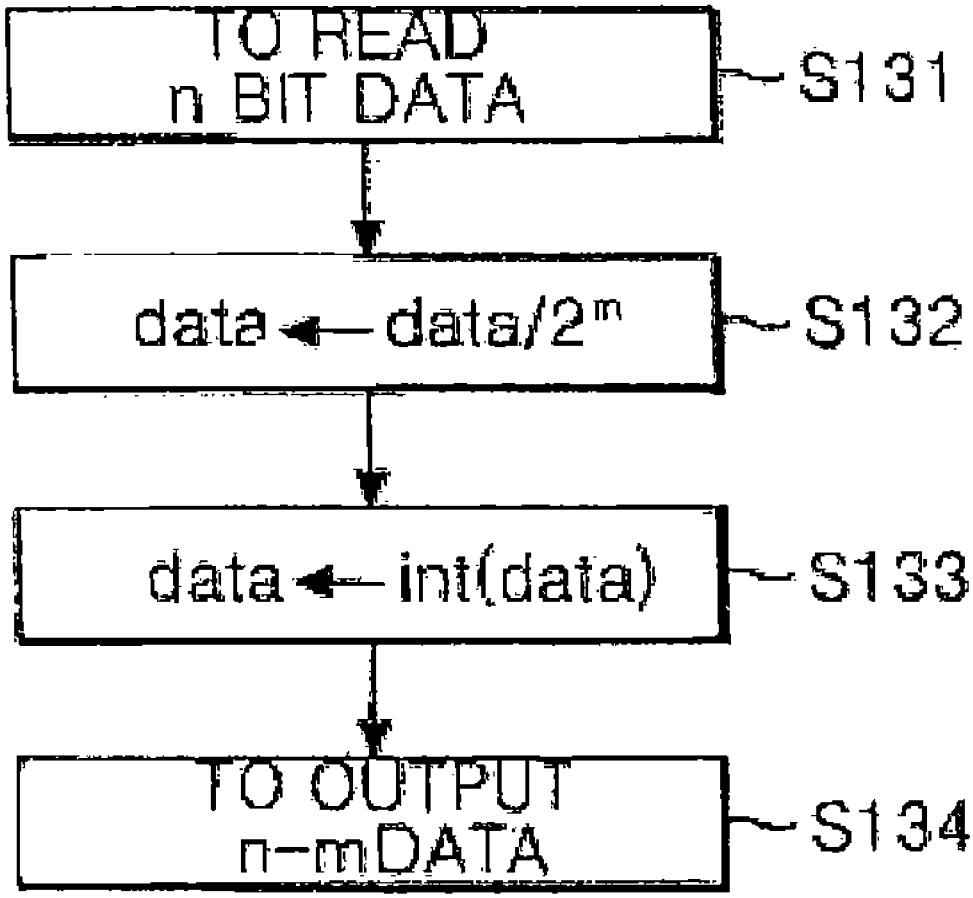
FIG. 13 is a flow chart representing an exemplary control sequence of a bit converter step by step in the fifth and sixth embodiments of the present invention, the bit converter reduces bits from n-bits to m-bits according to the present invention.

FIG. 13 is a flow chart representing an exemplary control sequence of a bit converter step by step in the fifth and sixth embodiments of the present invention, the bit converter reduces bits from n-bits to m-bits according to the present invention. Referring to FIG. 13, the bit converters 119 and 129 may receive the n-bit data to divide by 2m (steps S131 and S132). Subsequently, the bit converters 119 and 129 may round the divided value to the nearest whole number to make the divided value an integer (step S133). And, the bit converters 119 and 129 may supply the rounded data to the frame memory 118 and 128 and the lookup table 112 and 122 (step S134).

Figure 14:
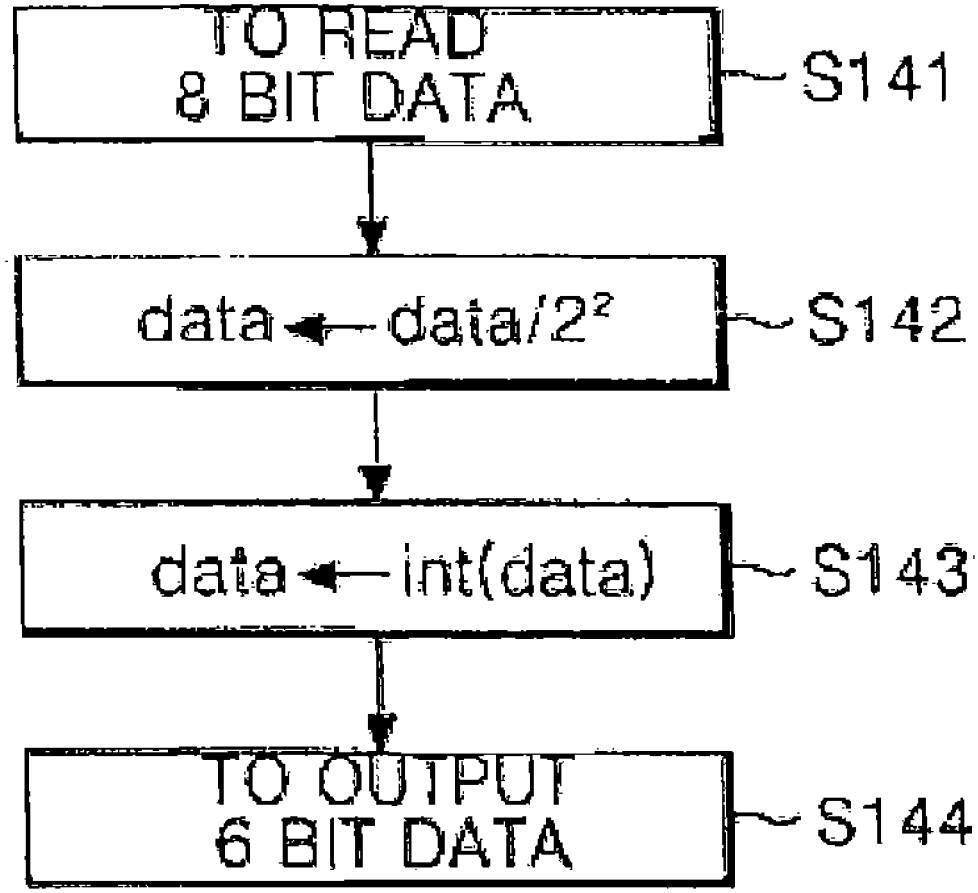
FIG. 14 is a flow chart representing an exemplary control sequence of a bit converter step by step, the bit converter converts 8-bit data into 6-bit data according to the present invention.

If the number of bits of the input data 'n' is '8' and the number of bits to be reduced 'm' is '2', the bit converter 119, 129, as shown in FIG. 14, may divide the 8-bit data by $2^2=4$, may convert the result to an integer, and may output the integral data (steps S141 to S144). For example, if the 8-bit source data is '129', the bit converter 119 and 129 may divide the data by '4', makes the result '32.25' an integer, and outputs the 6-bit data '32' (step S144).

TABLE 8

| Classification | data width of input data | memory capacity of lookup table | memory capacity of frame memory | data width of output data |
|---|---|---|---|---|
| 8-bit high-speed driving scheme of the related art | 8 bits | The number of addresses, of source data: $2^8 \times 2^8 = 2^{16}$ Data width of modulated data: 8 ->$2^{16} \times 8 = 0.52$ Mbits | The number of pixels: 1024 × 768 × 3 (RGB) data width: 8 ->18.87 Mbits | 8 bits |
| In the event that 8-bit data are converted into 6-bit data to be input to frame memory and lookup table | 8 bits | The number of addresses of source data: $2^6 \times 2^6 = 2^{12}$ Data width of modulated data: 8 ->$2^{12} \times 8 = 0.032$ Mbits | The number of pixels: 1024 × 768 × 3 (RGB) data width: 6 ->14.16 Mbits | 8 bits |

The memory capacity of the lookup table 112 and 122 and the frame memory 118 and 128 may be reduced to 0.032 Mbits and 14.16 Mbits, respectively, in the event that the 8-bit data are converted into the 6-bit data to be input to the frame memory 118 and 128 and the lookup table 112 and 122.

In the foregoing embodiments, the timing controller 51, 81, 91, 101, 111, 121, the bit converter 59A, 59B, 89A, 89B, 99, 109, 119, 129, and the lookup table 52, 82, 92, 202, 112, 122 may be integrated into a single chip. Further, the frame memory 58, 88, 98, 108, 118, 128 may be integrated into a single chip together with the timing controller 51, 81, 91, 101, 111, 121, the bit converter 59A, 59B, 89A, 89B, 99, 109, 119, 129, and the lookup table 52, 82, 92, 202, 112, 122.

Figure 15:
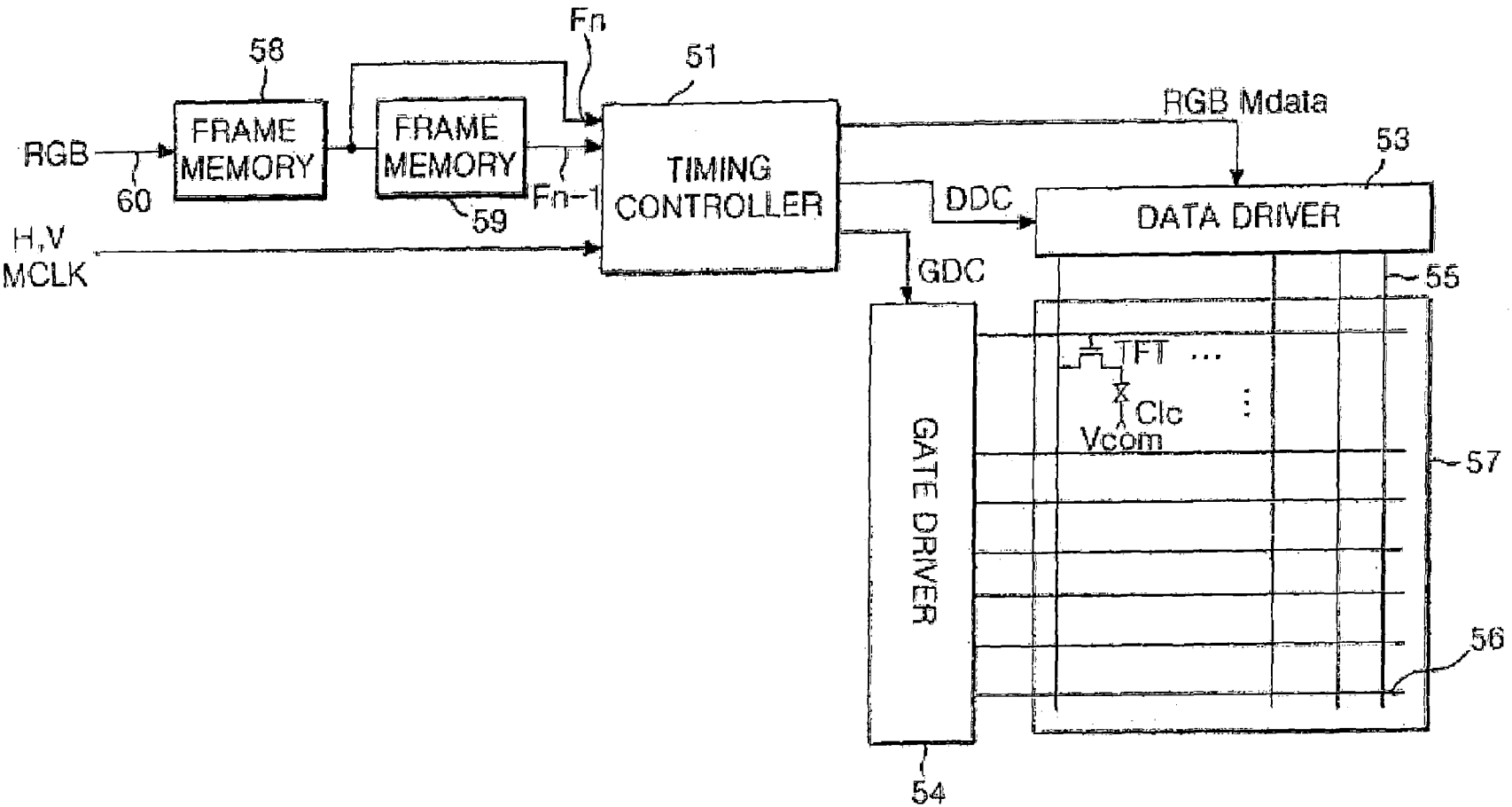
FIG. 15 is a block diagram representing an exemplary apparatus for driving a liquid crystal display according to a seventh embodiment of the present invention.

Alternatively, referring to FIG. 15, an apparatus for driving a liquid crystal display according to a seventh embodiment of the present invention may include a liquid crystal display panel 57 having data lines 55 and gate lines 56 crossing each other and having a TFT formed at each intersection part thereof to drive a liquid crystal cell Clc, a data driver 53 to supply data to the data lines 55 of the liquid crystal display panel 57, a gate driver 54 to supply scan pulses to the gate lines 56 of the liquid crystal display panel 57, a timing controller 51 for comparing the most significant 7-bits in the 8-bit source data to modulates the data and, in addition, generating timing control signals DDC and GDC, and first and second frame memories 58 and 59 connected between an input line 60 and the timing controller 51.

The liquid crystal display panel 57 may have liquid crystals injected between two glass substrates, and the data lines 55 and the gate lines 56 may be formed to perpendicularly cross each other on a lower glass substrate. The TFT provided at the intersection part of the data lines 55 and the gate lines 56 may supply the data through the data lines 55 to the liquid crystal cell Clc in response to the scan pulse from the gate lines 56. To this end, the gate electrode of the TFT May be connected to the gate lines 56 while the source electrode thereof may be connected to the data lines 55. The drain electrode of the TFT may be connected to a pixel electrode of the liquid crystal cell Clc.

The data driver 53 may include a shift register to sample a dot clock of the timing control signal DDC, a register to temporarily store data; a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 55 to which the data are outputted from the digital-to-analog converter, and an output buffer connected between the multiplexor and the data line. The data driver 53 may be supplied with red (R), green (G), and blue (B) modulated data Mdata modulated by the timing controller 51 and may supply the modulated data Mdata to the data lines 55 of the liquid crystal display panel 57 in response to a data control signal DDC from the timing controller 51.

The gate driver 54 may include a shift register to sequentially generate scan pulses in response to a gate control signal GDC received from the timing controller 51, and a level shifter to shift a voltage of the scan pulse into a level suitable for driving the liquid crystal cell Clc.

The timing controller 51 may compare the most significant 7-bits of the source data of the current frame Fn with those of the previous frame Fn−1, and may select the modulated data Mdata in correspondence to the result of the comparison, wherein the source data may be input from the first and second frame memories 58 and 59. The modulated data Mdata selected by the timing controller 51 may be input to the data driver 53. Further, the timing controller 51 may generate a gate control signal GDC to control the gate driver 54 and a data control signal DDC to control the data driver 53 by using horizontal and vertical synchronization signals H and V and a main clock MCLK.

The first frame memory 58 may store the data received from the input line 60 for one frame interval, and may supply the stored RGB data of the current frame Fn to the second frame memory 59 and the timing controller 51. The second frame memory 59 may store the data received from the first frame memory 58 for one frame interval, and may supply the stored RGB data of the previous frame Fn−1 to the timing controller 51.

Alternatively, an interface circuit may be installed between the input line 60 and the frame memory 58 to reduce data bus lines, wherein the interface circuit may adopt an interface system, such as a Low Voltage Differential Signaling LVDS system, a Transition Minimized Differential Signaling TMDS system, or Reduced Swing Differential Signaling RSDS system etc. Further, a bit conversion circuit or a 7-bit bus line may be installed at the input terminal of the first frame memory 58 or the output terminals of the first and second frame memories 58 and 59, wherein the bit conversion circuit casts away a least significant bit '2°' in the 8-bit source data and only takes most significant 7-bits.

Figure 16:
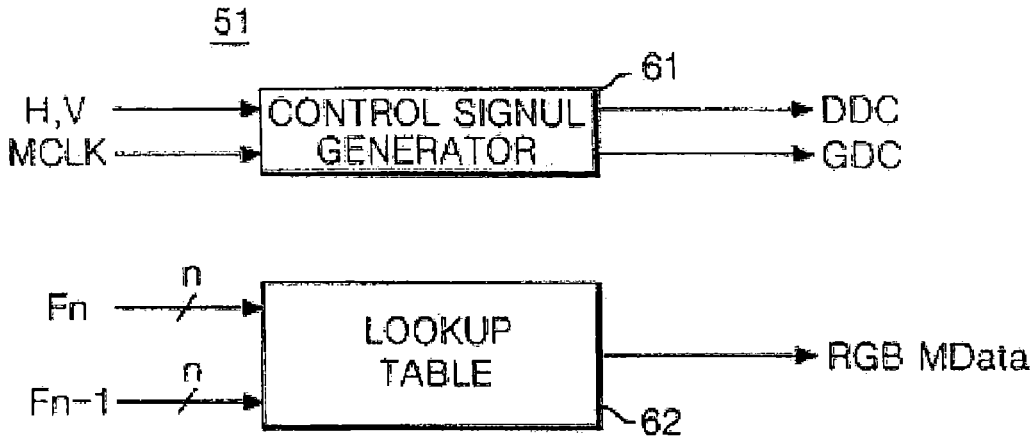
FIG. 16 is a block diagram representing an exemplary timing controller shown in FIG. 15 in detail according to the present invention.

FIG. 16 is a block diagram representing an exemplary timing controller shown in FIG. 15 in detail according to the present invention. Referring to FIG. 16, the timing controller 151 may include a control signal generator 161 to generate a gate control signal GDC and a data control signal DDC, and a lookup table 162 to compare 7-bit source data of the current frame Fn with those of the previous frame Fn−1 and to output 8-bit modulated data.

The control signal generator 161 may generate gate control signals GDC including a gate start pulse GSP, a gate shift clock GSC and a gate output enable GOE etc by using vertical/horizontal synchronization signals V/H and a main clock MCLK; and may generate data control signals DDC including a data enable signal DE, a source shift clock SSC, a source start pulse SSP, a polarity control signal POL and a source output enable signal SOE etc.

The lookup table 162 may compare the most significant 7-bits '$2^7$, $2^6$, $2^5$, $2^4$, $2^3$, $2^2$, $2^1$' of the current frame En with the most significant 7-bits '$2^7$, $2^6$, $2^5$, $2^4$, $2^3$, $2^2$, $2^1$' of the previous frame Fn−1, and may select the 8-bit modulated data in accordance with the result of the comparison.

The data '200' and '201' input to the timing controller 151 may be expressed as '1110010002' and '$1101001_2$' in binary number. The most significant 7-bits '$2^7$, $2^6$, $2^5$, $2^4$, $2^3$, $2^2$, $2^1$' of the data may be the same and only the least significant bit '$2^0$' may be different. Accordingly, if the data supplied to the input line 160 are '200' and '201', '1100100' is input into the lookup table 162.

The modulated data registered at such a lookup table 162 may satisfy the foregoing high-speed drivirig condition like Formulas (3) to (5). In Formulas (3) to (5), VDn−1 represents a data voltage of the previous frame, VDn represents a data voltage of the current frame, and MVDn represents a modulated data voltage. With respect to Formula (5), if the modulated data Mdata is higher than an optimum value, an overshoot is generated electrically/optically. With respect to Formula (3), if the modulated data Mdata is lower than the optimum value, an undershoot may be generated electrically/optically. Herein, an observer subjectively perceives a more intense deterioration in picture quality in case of the overshoot because the overshoot causes a picture brightness to rapidly increase, but the observer subjectively perceives almost no deterioration in picture quality in case of the undershoot. Accordingly, it is desirable to set the modulated data registered in the lookup table 162 as a value with which no overshoot but undershoot is generated.

Figure 17:
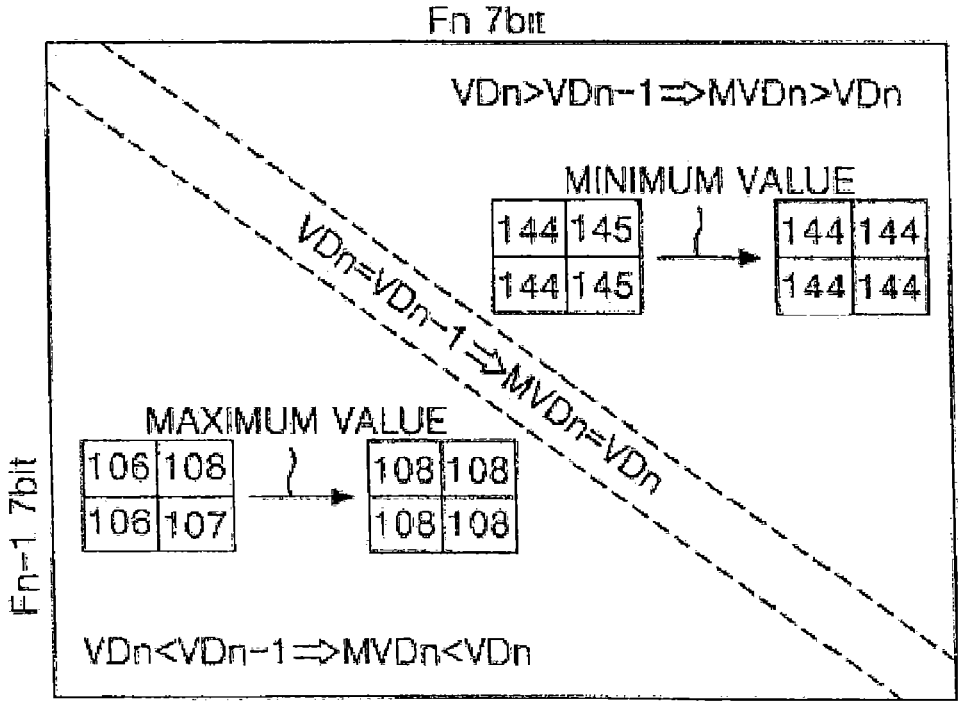
FIG. 17 is a diagram representing an exemplary method for setting modulated data for the lookup table shown in FIG. 16 according to the present invention.

To this end, when dividing the modulated data Mdata registered at the lookup table 162 into three bands of Formulas (3) to (5), each small band with adjacent four modulated data Mdata among the modulated data bands satisfying Formula (3) as in FIG. 17 is set to be a maximum value. Further, each small band with adjacent four modulated data Mdata among the modulated data bands satisfying Formula (5) is set to be a minimum value. In FIG. 17, the modulated data Mdata in the data band satisfying Formula (4) are set to be the same as the RGB data currently input. Accordingly, the lookup table 162 is set in the same way as the foregoing Table 4 and 5.

Accordingly, the memory capacity of the lookup table 162 according to the seventh embodiment of the present invention may bes 16,384×8=131,072 bits. When taking red, green and blue RGB into consideration, the memory capacity of the lookup table may be 16,384×8×3=393,216 bits. The memory capacity of the lookup table may be sharply reduced in comparison with the lookup table where the source data are compared by the 8-bits and the modulated data are set to be 8-bits. Herein, the first term '16,384' of the left side is a product (128×128) of the 7-bit source data of the current frame Fn and those of the previous frame Fn−1, and the second term '8' of the left side is the data width, 8-bits, of the modulated data.

Figure 18:
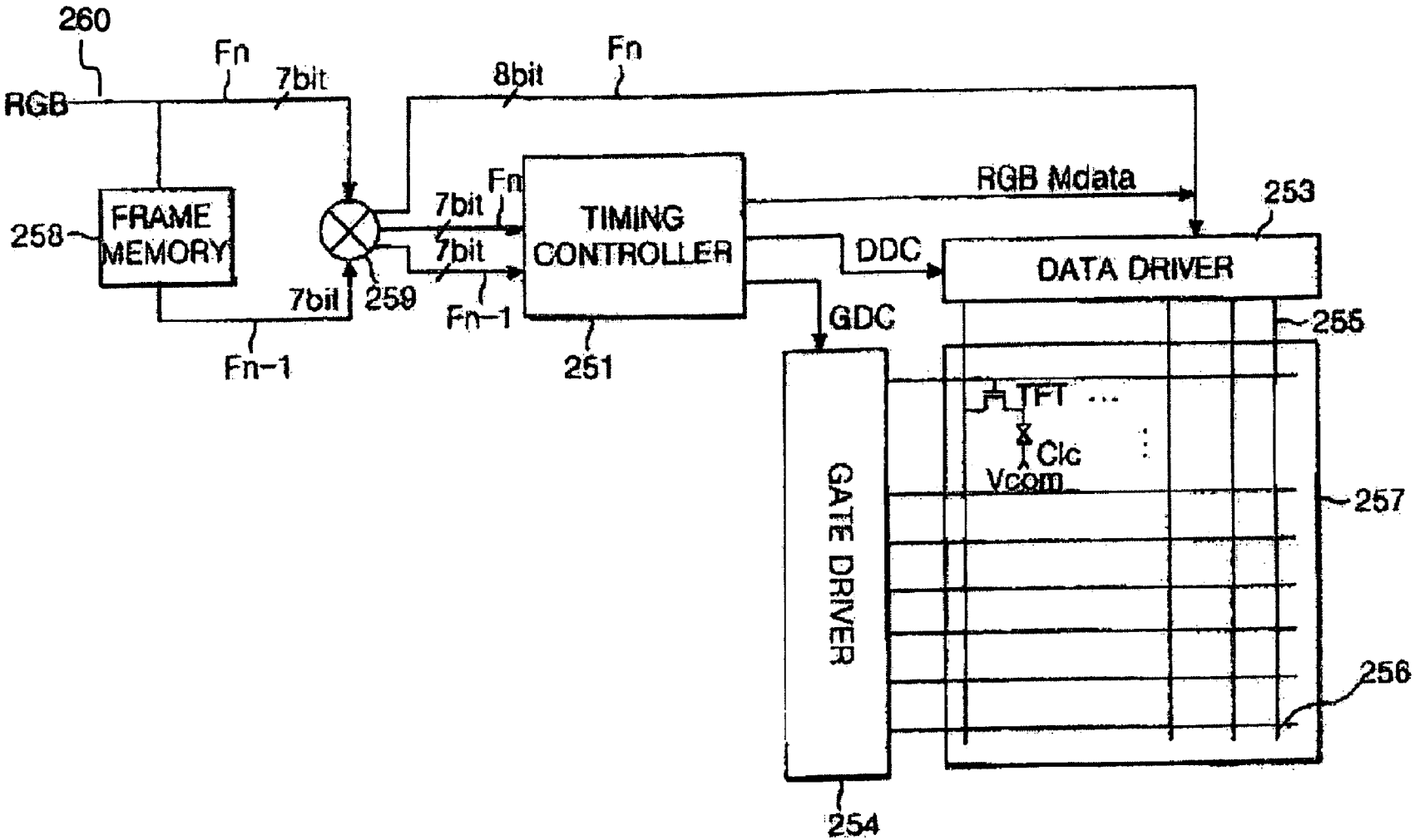
FIG. 18 is a block diagram representing an exemplary apparatus for driving a liquid crystal display according to a eighth embodiment of the present invention.

Alternatively, referring to FIG. 18, an apparatus for driving a liquid crystal display according to an eighth embodiment of the present invention may include a liquid crystal display panel 257 having data lines 255 and gate lines 256 crossing each other and having a TFT formed at each intersection part thereof to drive a liquid crystal cell Clc, a data driver 253 to supply data to the data lines 255 of the liquid crystal display panel 257, a gate driver 254 to supply scan pulses to the gate lines 256 of the liquid crystal display panel 257, a timing controller 251 for comparing the most significant 7-bits of the current source data with those of the previous source data to modulates the data and, in addition, generating timing control signals DDC and GDC, a frame memory 258 connected between an input line 260 and the timing controller 251, and a comparator 259 connected between the frame memory 258 and the timing controller 251 for comparing the most significant 7-bits of the previous source data with those of the current source data.

The liquid crystal display panel 257 may have liquid crystals injected between two glass substrates, and the data lines 255 and the gate lines 256 may be formed to perpendicularly cross each other on a lower glass substrate. The TFT provided at the intersection part of the data lines 255 and the gate lines 256 may supply the data through the data lines 255 to the liquid crystal cell Clc in response to the scan pulse from the gate lines 256. To this end, the gate electrode of the TFT may be connected to the gate lines 256 while the source electrode thereof may be connected to the data lines 255. The drain electrode of the TFT may be connected to a pixel electrode of the liquid crystal cell Clc.

The data driver 253 may include a shift register to sample a dot clock of the timing control signal DDC; a register to temporarily store data, a latch to store the data by lines and to simultaneously output the stored data of one line in response to the clock signal from the shift register, a digital-to-analog converter to select a positive/negative gamma voltage in correspondence to the digital data value from the latch, a multiplexor to select a data line 255 to which the data are outputted from the digital-to-analog converter, and an output buffer connected between the multiplexor and the data line. The data driver 253 may be supplied with red (R), green (G), and blue (B) modulated data Mdata modulated by the timing controller 251 and may supply the modulated data Mdata to the data lines 255 of the liquid crystal display panel 257 in response to a data control signal DDC from the timing controller 251.

The gate driver 254 may include a shift register to sequentially generate scan pulses in response to a gate control signal GDC received from the timing controller 251, and a level shifter to shift a voltage of the scan pulse into a level suitable for driving the liquid crystal cell Clc.

The RGB data received from the input line 260 may be supplied to the input terminal of the frame memory 258 and a first input terminal of the comparator 259. The frame memory 258 may store the source RGB data from the input line 260 for one frame interval, and may supply the stored source RGB data of the current frame Fn to a second input terminal of the comparator 259.

The comparator 259 may compare the most significant 7-bits of the current frame source RGB data from the input line 260 with those of the previous frame source RGB data from the frame memory 258, and may supply the current frame source RGB data to the data driver 253 or the previous frame source RGB data from the frame memory 258 to the timing controller 251 in accordance with the result of the comparison. At this moment, an interface circuit may be installed between the input line 260 and the frame memory 258 and between the input line 260 and the first input terminal of comparator 259 to reduce data bus lines, wherein the interface circuit may adopt an interface system, such as a Low Voltage Differential Signaling LVDS system, a Transition Minimized Differential Signaling TMDS system, or Reduced Swing Differential Signaling RSDS system etc. Further, a bit conversion circuit or a 7-bit bus line may be installed at the output terminal of the frame memory 258 or the second input terminals of the comparator 259, wherein the bit conversion circuit may cast away a least significant bit '$2^0$' in the 8-bit source data and may only take most significant 7-bits.

Figure 19:
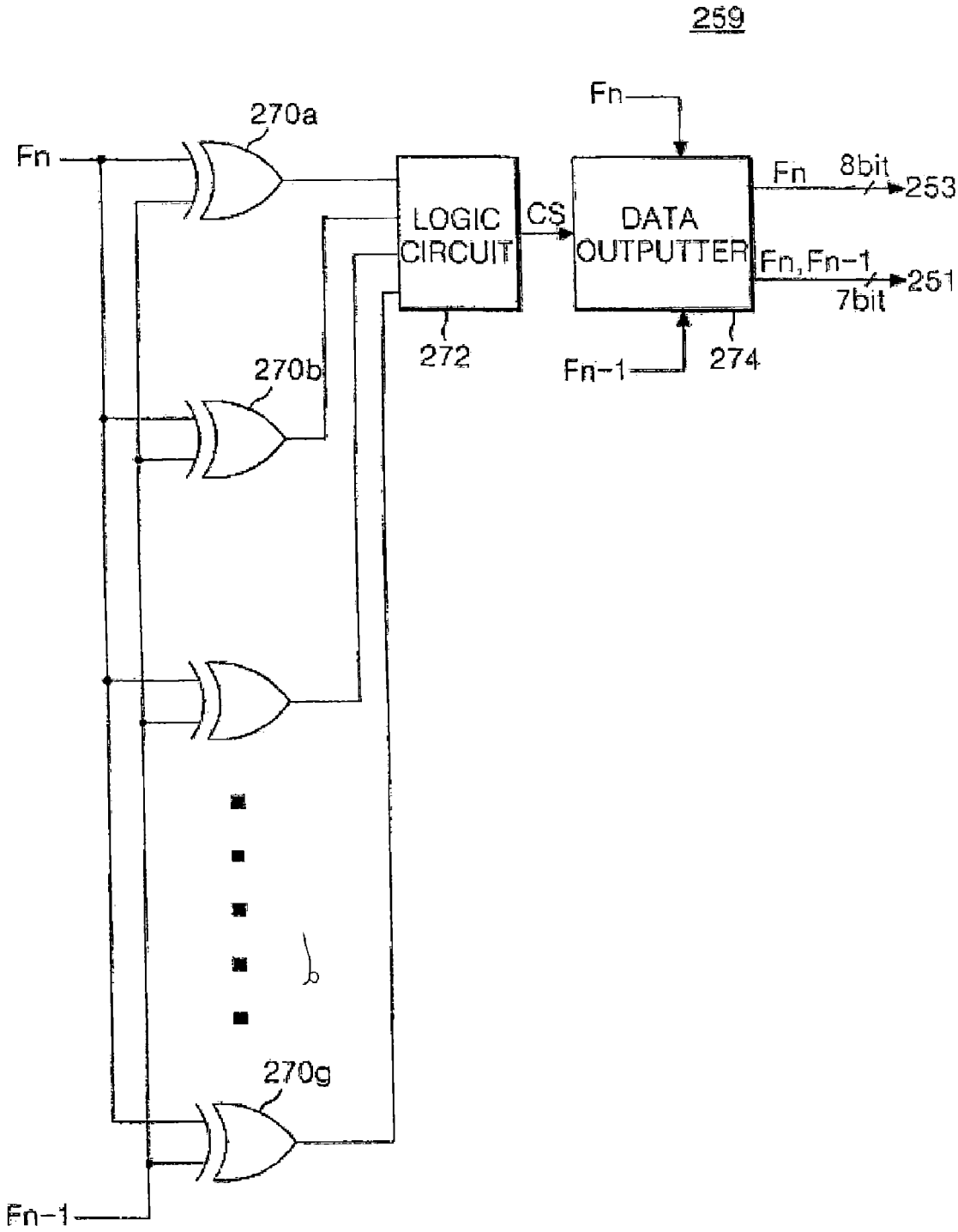
FIG. 19 is a circuit diagram representing an exemplary comparator shown in FIG. 18 according to the present invention.

FIG. 19 is a circuit diagram representing an exemplary comparator shown in FIG. 18 according to the present invention. In FIG. 19, the comparator 259 may include first to seventh XOR gates 270A to 270G, a logic circuit receiving an output signal from each of the first to seventh XOR gates 270A to 270G to output a one-bit logical value, and a data outputter to supply the source RGB data of the current frame Fn to the data driver 253 or to supply the source RGB data of the current frame Fn and the source RGB data of the previous frame Fn−1 to the timing controller 251 in response to the logical signal from the logic circuit 272.

The source RGB data of the current frame Fn from the input lines 260 may be supplied to the first input terminal of each of the first to seventh XOR gates 270A to 270G, and the source RGB data of the previous frame Fn-1 from the frame memory 258. That is, each bit of the 7-bit data of the current frame Fn and the previous frame Fn−1 may be supplied to the first to seventh XOR gates 270A to 270G. In other words, the data '100' and '101' input to the comparator 259 may be expressed as '$\mathbf{01100100}_2$' and '$01100101_2$' in binary number. The most significant 7-bits '$2^7$, $2^6$, $2^5$, $2^4$, $2^3$, $2^2$, $2^1$' of the data may be the same and only the least significant bit '$2^0$' may be different. Accordingly, if the data supplied to the input line 260 are '100' and '101', '0110010' may be input into the comparator 259.

Accordingly, if the data supplied to the first input terminal and the second input terminal are the same logical values then each of the first to seventh XOR gates 270A to 270G may supply the logical value '0' or 'LOW' to the logic circuit 272. Alternatively, if the data are not the same logical values, then each of the first to seventh XOR gates 270A to 270G may supply the logical value '1' or 'HIGH' to the logic circuit 272.

The logic circuit may receive the output signal from each of the first to seventh XOR gates 270A to 270G. Accordingly, if the output signal from each of the first to seventh XOR gates 270A to 270G is the same, then the logic circuit 272 may supply the logical value '0' or 'LOW' to the data outputter 274. If at least one of the output signals differs from the others, then the logic circuit 272 may supply the logical value '1' or 'HIGH' to the data outputter 274.

The data outputter 274 may supply the 8-bit source RGB data of the current frame Fn to the data driver 253 if the logical value supplied from the logic circuit 272 is '0' or 'LOW', and may supply the 7-bit source RGB data of the current frame Fn and the 7-bit source RGB data of the previous frame Fn−1 to the timing controller 251 if the logical value is '1' or 'HIGH'.

In this way, the comparator 259 may compare the most significant 7-bits of the source RGB data of the current frame Fn supplied from the input line 260 with those of the previous frame Fn−1 supplied from the frame memory 258, and if they are identical, the source RGB data of the current frame Fn may be supplied to the data driver 253. Whereas, the comparator 259 may compare the most significant 7-bits of the source RGB data of the current frame Fn supplied from the input line 260 with those of the previous frame Fn−1 supplied from the frame memory 258, and if they are not identical, the source RGB data of the current frame Fn and the source RGB data of the previous frame Fn−1 may be supplied to the timing controller 251.

The timing controller 251 may compare the source data of the current frame Fn with those of the previous frame Fn−1 by the 7-bits, and may select the modulated data Mdata in accordance with the result of the comparison. The modulated data Mdata selected by the timing controller 251 may be input to the data driver 253. Further, the timing controller 251 may generate a gate control signal GDC to control the gate driver 254 and a data control signal DDC to control the data driver 253 by using horizontal and vertical synchronization signals H and V and a main clock MCLK.

To this end, the timing controller 251, as shown in FIG. 16, may include a control signal generator 161 to generate the gate control signal GDC and the data control signal DDC, and a lookup table 162 for comparing the 7-bit source data of the current frame Fn with those of the previous frame Fn−1 to output the 8-bit modulated data.

The control signal generator 161 may generate gate control signals GDC including a gate start pulse GSP, a gate shift clock GSC and a gate output enable GOE etc by using vertical/horizontal synchronization signals V/H and a main clock MCLK; and may generate data control signals DDC including a data enable signal DE, a source shift clock SSC, a source start pulse SSP, a polarity control signal POL and a source output enable signal SOE.

The lookup table 162 may compare the most significant 7-bits '$2^7$, $2^6$, $2^5$, $2^4$, $2^3$, $2^2$, $2^1$' of the current frame Fn with the most significant 7-bits '$2^7$, $2^6$, $2^5$, $2^4$, $2^3$, $2^2$, $2^1$' of the previous frame Fn−1, and may select the 8-bit modulated data in accordance with the result of the comparison.

The data '100' and '101' input to the timing controller 251 from the comparator 259 may be expressed as '011001002' and '011001012' in binary number. The most significant 7-bits '$2^7$, $2^6$, $2^5$, $2^4$, $2^3$, $2^2$, $2^1$' of the data may be the same and only the least significant bit '$2^0$' may be different. Accordingly, '$0110010_2$', i.e., '50', may be input into the lookup table 162 if the data input from the comparator 259 are '100' and '101'.

The modulated data registered at such a lookup table 162 may satisfy the foregoing high-speed driving condition like Formulas (3) to (5). In Formulas (3) to (5), VDn−1 represents a data voltage of the previous frame, VDn represents a data voltage of the current frame, and MVDn represents a modulated data voltage. With regard to Formula (5), if the modulated data Mdata is higher than an optimum value, an overshoot may be generated electrically/optically. With regard to Formula (3), if the modulated data Mdata is lower than the optimum value, an undershoot may be generated electrically/optically. Herein, an observer subjectively perceives a more intense deterioration in picture quality in case of the overshoot because the overshoot causes a picture brightness to rapidly increased but the observer subjectively perceives almost no deterioration in picture quality in case of the undershoot. Accordingly, it may be desirable to set the modulated data registered in the lookup table 162 as a value with which an observer can perceive the difference subjectively even though no overshoot is generated.

Figure 20:
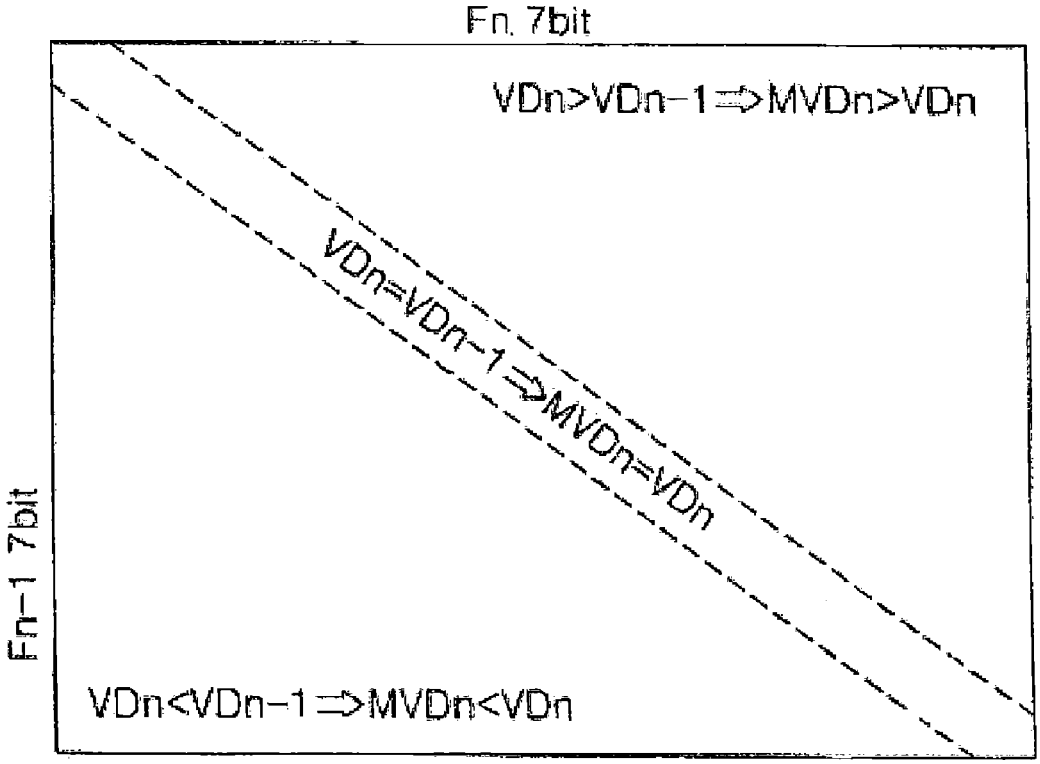
FIG. 20 is a diagram representing an exemplary method for setting modulated data for a lookup table shown in FIG. 18 according to the present invention.

To this end, when the modulated data Mdata registered in the lookup table 162 are divided into three bands of Formulas (3) to (5), each small band where four modulated data Mdata are adjacent in modulated data bands that satisfy the Formula (5) as in FIG. 20 may be set to have a value higher than the source data of the current frame. Further, each small band where four modulated data Mdata are adjacent in modulated data bands that satisfy the Formula (3) may be set to have a value lower than the source data of the current frame. In FIG. 18, data bands satisfying Formula (4) have the modulated data Mdata set to be the same as the RGB data currently input.

The corresponding modulated data Mdata registered in the lookup table 162 are shown as the following Table 9. In Table 9, if the 7-bit data input in the current frame is '70', the 8-bit data supplied to the input line 260 may be '140' or '141'. Further, if the 7-bit data input in the previous frame is '127', the 8-bit data supplied to the input line 260 maybe '255' or '256'.

Accordingly, in the data band satisfying the foregoing Formula (4), the modulated data Mdata may be set to be the same as the RGB data input in the current frame Fn. That is, in the data band satisfying the Formula (4), the comparator 259 may compare the source RGB data of the current frame En with the source data of the previous frame Fn−1 supplied from the frame memory 258 by the 7-bits and the two source data may be determined to be the same, thus the RGB data input in the current frame Fn may be supplied to the data driver 253. Values with which an undershoot are generated may be set as the modulated data Mdata in the modulated data bands satisfying the foregoing Formula (3) in Table 9.

Specifically, the modulated data bands satisfying the Formula (3) may be set to have the value lower than the RGB data input in the current frame Fn. Further, in the modulated data bands satisfying the foregoing Formula (5) in Table 9, the modulated data Mdata may be set to be a value with which an observer cannot perceive any difference subjectively. That is, the modulated data bands satisfying the Formula (5) may be set to have the value higher than the RGB data input in the current frame Fn.

In this way, the apparatus for driving the liquid crystal display according to the eighth embodiment of the present invention may compare the data of the previous frame with those of the current frame by the 7-bits before comparing at the lookup table by the 7-bits, and if the two data are equal, the data of the current frame may be supplied to the liquid crystal display panel.

TABLE 9

| | | | | | | | current frame 7 bit데이터값 | | | | | | | | | | |
|---|---|---|---|---|---|---|---|---|---|---|---|---|---|---|---|---|---|
| 0 | 1 | . . . | 70 | 71 | 72 | 73 | 74 | 75 | 76 | . . . | 100 | 101 | 102 | 103 | 104 | . . . | 127 |
| previous frame 7 bit데이터값 | | | | | | | | | | | | | | | | | |
| 1 | 1 | . . . | . . . | . . . | . . . | . . . | . . . | . . . | . . . | . . . | . . . | . . . | . . . | . . . | . . . | . . . | . . . |
| . . . | . . . | . . . | . . . | . . . | . . . | . . . | . . . | . . . | . . . | . . . | . . . | . . . | . . . | . . . | . . . | . . . | . . . |
| 70 | . . . | . . . | 140 | 141 | 143 | 144 | 145 | 147 | 148 | . . . | 227 | 229 | 230 | 232 | 235 | . . . | 255 |
| 71 | . . . | . . . | 140 | 141 | 143 | 144 | 145 | 147 | 148 | . . . | 227 | 229 | 229 | 231 | 234 | . . . | 255 |
| 72 | . . . | . . . | 139 | 140 | 142 | 143 | 144 | 146 | 147 | . . . | 226 | 228 | 229 | 230 | 233 | . . . | 254 |
| 73 | . . . | . . . | 138 | 139 | 140 | 143 | 144 | 146 | 147 | . . . | 225 | 228 | 229 | 230 | 232 | . . . | 254 |
| 74 | . . . | . . . | 138 | 139 | 140 | 142 | 144 | 146 | 147 | . . . | 225 | 227 | 228 | 229 | 230 | . . . | 253 |
| 75 | . . . | . . . | 137 | 138 | 139 | 142 | 143 | 145 | 146 | . . . | 224 | 226 | 227 | 228 | 230 | . . . | 252 |
| 76 | . . . | . . . | 137 | 137 | 139 | 140 | 142 | 144 | 146 | . . . | 224 | 225 | 226 | 227 | 228 | . . . | 251 |
| . . . | . . . | . . . | . . . | . . . | . . . | . . . | . . . | . . . | . . . | . . . | . . . | . . . | . . . | . . . | . . . | . . . | . . . |
| 100 | . . . | . . . | 50 | 51 | 52 | 54 | 56 | 58 | 60 | . . . | 200 | 202 | 204 | 205 | 206 | . . . | 245 |
| 101 | . . . | . . . | 48 | 50 | 52 | 53 | 55 | 57 | 59 | . . . | 199 | 201 | 203 | 205 | 206 | . . . | 245 |
| 102 | . . . | . . . | 48 | 50 | 51 | 52 | 54 | 56 | 58 | . . . | 198 | 200 | 202 | 204 | 205 | . . . | 243 |
| 103 | . . . | . . . | 46 | 48 | 50 | 52 | 54 | 55 | 57 | . . . | 196 | 200 | 201 | 203 | 205 | . . . | 243 |
| 104 | . . . | . . . | 46 | 48 | 50 | 48 | 50 | 54 | 56 | . . . | 195 | 198 | 199 | 202 | 204 | . . . | 242 |
| . . . | . . . | . . . | . . . | . . . | . . . | . . . | . . . | . . . | . . . | . . . | . . . | . . . | . . . | . . . | . . . | . . . | . . . |
| 127 | . . . | . . . | 44 | 46 | 48 | 46 | 48 | 53 | 55 | . . . | 101 | 104 | 106 | 110 | 115 | . . . | 255 |

As described above, the method and apparatus for driving the liquid crystal display according to the present invention may reduce the number of bits of the data input to the lookup table and the frame memory thereby reducing the memory capacity of the lookup table and the frame memory, and thereby reducing a manufacturing cost as well as a chip-size. Further, the method and apparatus for driving the liquid crystal display according to the present invention may modulate the input data by the high-speed driving scheme to improve a picture quality. Furthermore, the method and apparatus for driving the liquid crystal display according to the present invention may enable fitting of the timing controller, the lookup table and the bit converter into one chip to simplify a configuration and, in addition, reduce the number of bus lines formed on the printed circuit board PCB and electromagnetic interference EMI.

It will be apparent to those skilled in the art that various modifications and variations can be made in the method and apparatus for driving a liquid crystal display of the present invention without departing from the spirit or scope of the invention. Thus, it is intended that the present invention cover the modifications and variations of the invention provided they come within the scope of the appended claims and their equivalents.

What is claimed is:

1. A method for driving a liquid crystal display, comprising:

receiving source data;

reducing the number of bits of the source data, thereby generating a reduced-bit source data, wherein reducing the number of bits includes converting an odd source data value into an even source data value having the same number of bits as the odd source data, and then reducing the number of bits of the converted even source data;

comparing the reduced-bit source data of a previous frame with the reduced-bit source data of a current frame to select a preset modulated data in accordance with the result of the comparison, wherein a bit number of the reduced-bit source data of the previous frame is the same as that of the current frame, and a bit number of the preset modulated data is more than that of the reduced-bit source data of each previous frame and current frame; and modulating the source data by using the selected modulated data.

2. The method of claim 1, wherein the selected modulated data is set to be a minimum value within a data band that includes a plurality of initial modulated data, wherein each of the initial modulated data is larger than a current data value of the current frame, when the current data value of the current frame is larger than a previous data value of a previous frame.

3. The method of claim 1, wherein the selected modulated data is set to be a maximum value within a data band that includes a plurality of initial modulated data, wherein each of the initial modulated data is smaller than a current data value of the current frame, when the current data value of the current frame is smaller than a previous data value of a previous frame.

4. The method of claim 1, wherein the source data is modulated to a current data value of the current frame, in modulating the source data, when the current data value of a current frame is the same as a previous data value of the previous frame.

5. The method of claim 1, further comprising delaying the reduced-bit source data by one frame interval.

6. The method of claim 5, wherein the source data is an 8-bit data, and the reduced-bit source data is a 7-bit data.

7. A method for driving a liquid crystal display, comprising:

setting a first n bit modulated data that has a larger value than a data value of a current frame in accordance with an increase of the data value, wherein n is a positive integer;

setting a second n bit modulated data that has a smaller value than the data value of the current frame in accordance with a decrease of the data value;

storing in a storage memory an n-bit source data, wherein n is a positive integer;

determining whether an n−k bit source data of the current frame is identical to an n−k bit source data of the previous frame stored in the storage memory, wherein k is a positive integer less than n, and wherein the n−k bit source data corresponds to most significant n−k bits of the n bits; and supplying the n bit source data of the current frame to a liquid crystal display panel or modulating an n−k bit source data by using one of the first and second n bit modulated data in accordance with a result of the determining whether an n−k bit source data of the current frame is identical to an n−k bit source data of the previous frame, wherein modulating an n−k source data includes replacing all of the bits within the n bit source data with the n bit modulated data.

8. The method of claim 7, wherein n is 8 and k is 1.

9. The method of claim 7, wherein the supplying the source data includes:

supplying the n bit source data of the current frame to the liquid crystal display panel, when the n-bit source data value of the current frame is identical to the source data value of the previous frame; and comparing n−k bits from the source data of the current frame with corresponding n−k bits from the source data of the previous frame, wherein k is a positive integer less than n, to modulate the source data by using the first and second modulated data, when the n bit source data value of the current frame differs from the n bit source data value of the previous frame.

10. The method of claim 9, wherein modulating the n−k bit source data includes:

modulating the n−k bit source data by using the first modulated data, when the n bit source data value of the current frame is larger than the n bit source data value of the previous frame; and modulating the n−k bit source data by using the second modulated data, when the n bit source data value of the current frame is smaller than the n bit source data value of the previous frame.

11. An apparatus for driving a liquid crystal display, comprising:

a liquid crystal display panel comprising a plurality of data lines, and a plurality of gate lines, wherein the data lines cross the gate lines, and a liquid crystal cell is formed at a pixel area between a data line and a gate line;

an input line for receiving n-bit source data, wherein n is a positive integer;

a storage memory for storing the received source data;

a comparator for determining whether an n−k bit source data of a current frame is identical in n−k bits to the source data of a previous frame from the storage memory, wherein k is a positive integer less than n; and a modulator for registering a first n bit modulated data that has a larger value than a data value of the current frame in accordance with an increase of the data value, and a second n bit modulated data that has a smaller value than the data value of the current frame in accordance with a decrease of the data value, and for supplying the source data of the current frame to the liquid crystal display panel, or modulating the n−k bit source data by using the first and second n bit modulated data in accordance with an output of the comparator, wherein modulating includes replacing all of the bits of the source data with the n bit modulated data.

12. The apparatus of claim 11, wherein the comparator supplies the data of the current frame to the liquid crystal display panel when the data value is the same between the previous frame and the current frame, and supplies the n−k bit source data of the current frame and the n−k bit source data of the previous frame to the modulator when the data value is not the same between the previous frame and the current frame.

13. The apparatus of claim 11, wherein the comparator supplies the data of the current frame to the liquid crystal display panel when the data value is the same between the previous frame and the current frame, and supplies the n−k bit source data of the current frame and the n−k bit source data of the previous frame to the modulator when the data value is not the same between the previous frame and the current frame.

14. The apparatus of claim 11, further comprising:

a data driver for supplying the n bit modulated data from the modulator to the data line of the liquid crystal display panel;

a gate driver for supplying a scan signal to the gate line of the liquid crystal display panel; and a timing controller for controlling the data driver and the gate driver.

15. The apparatus of claim 14, wherein the modulator is a lookup table integrated into the timing controller.

16. The apparatus of claim 11, wherein n is 8, and k is 1.

* * * * *